US006224472B1

(12) United States Patent
Lai et al.

(10) Patent No.: US 6,224,472 B1
(45) Date of Patent: May 1, 2001

(54) RETAINING RING FOR CHEMICAL MECHANICAL POLISHING

(75) Inventors: Lei Ping Lai; Joshua L. Tucker, both of Austin; Randall J. Lujan, Pflugerville, all of TX (US)

(73) Assignee: Samsung Austin Semiconductor, L.P., Austin, TX (US)

( * ) Notice: Subject to any disclaimer, the term of this patent is extended or adjusted under 35 U.S.C. 154(b) by 0 days.

(21) Appl. No.: 09/344,297

(22) Filed: Jun. 24, 1999

(51) Int. Cl.[7] ..... B24B 5/00
(52) U.S. Cl. ..... 451/398; 451/288; 451/290
(58) Field of Search ..... 451/41, 285, 286, 451/287, 288, 289, 290, 398

(56) References Cited

U.S. PATENT DOCUMENTS

| | | | | |
|---|---|---|---|---|
| 5,597,346 | | 1/1997 | Hempel, Jr. | 451/287 |
| 5,679,065 | | 10/1997 | Henderson | 451/290 |
| 5,681,215 | | 10/1997 | Sherwood et al. | 451/388 |
| 5,695,392 | | 12/1997 | Kim | 451/288 |
| 5,803,799 | * | 9/1998 | Volodarsky et al. | 451/288 |
| 5,931,725 | * | 8/1999 | Inaba et al. | 451/288 |
| 5,941,758 | * | 8/1999 | Mack | 451/41 |
| 6,004,193 | * | 12/1999 | Nagahara et al. | 451/285 |
| 6,093,089 | * | 7/2000 | Chen et al. | 451/288 |
| 6,110,025 | * | 8/2000 | Williams et al. | 451/286 |
| 6,116,992 | * | 9/2000 | Prince | 451/286 |

* cited by examiner

*Primary Examiner*—Timothy V. Eley
(74) *Attorney, Agent, or Firm*—Timothy M. Honeycutt

(57) ABSTRACT

Methods and apparatus for chemical mechanical polishing of substrates, such as semiconductor wafers, which employ retaining rings to hold a substrate in place during the polishing process. The retaining rings have surface characteristics that may be used to improve polishing uniformity, especially at a wafer periphery, and/or to improve removal rate of a chemical mechanical polishing ("CMP") system. The surface characteristics may be recesses and/or protrusions on the pad-facing surface of a CMP retaining ring, which during polishing contact and act to flatten a CMP polishing pad beneath the substrate. Near the edge the surface characteristics may also condition the surface of a polishing pad during polishing and may be further configured to improve slurry transport.

22 Claims, 12 Drawing Sheets

RETAINING RING FOR CHEMICAL MECHANICAL POLISHING

BACKGROUND OF THE INVENTION

1. Field of the Invention

This invention relates to polishing of substrates, and more particularly to retaining ring apparatus for retaining a substrate during polishing. Specifically, this invention relates to retaining rings having surface characteristics for improving polishing uniformity and/or removal rate of a chemical mechanical polishing ("CMP") system.

2. Description of Related Art

Thin substrates, such as silicon substrates or wafers used in semiconductor fabrication, may be polished or planarized using a CMP system. Typical CMP systems function with a substrate disposed between a carrier or pressure plate and a polishing pad supported by a rotatable polishing table or platen. A circular-shaped retaining ring is typically attached to the carrier plate. During polishing, a substrate (such as semiconductor wafer) is disposed and contained between the carrier plate and polishing pad by the retaining ring. To affect polishing, the carrier plate and/or the polishing pad are brought into close proximity and moved relative to one another to impart a polishing motion to the substrate The polishing pad and/or carrier plate (including the substrate) are typically rotated at differential velocities to cause relative motion between the polishing pad and the substrate surface. Lateral, or side to side motion between the polishing pad and substrate surface may also be imparted. An abrasive slurry, such as a colloidal silica slurry may be provided between the polishing pad and substrate to facilitate polishing.

A carrier plate and retaining ring of a CMP system are typical parts of a head assembly of a CMP apparatus. The carrier plate may include vacuum ports or other mechanism for retaining a substrate against the carrier plate surface. A retaining ring is provided to prevent the substrate from being dislodged from the carrier plate during polishing. In one traditional design, a retaining ring is fixedly attached to a carrier plate and dimensioned such that the pad-side surface of the retaining ring does not contact a polishing pad surface during polishing. Instead the substrate extends beyond the surface of the retaining ring and contacts the polishing pad prior to contact with the retaining ring, thus allowing polishing of the substrate surface to occur. Because the substrate extends beyond the retaining ring during polishing, the substrate may sometimes slip out through the gap existing between the retaining ring and the polishing pad.

To reduce the potential for substrate slippage and improve edge uniformity, CMP head assemblies having an independently acting retaining ring and carrier or pressure plate have been developed. Such a system is described in U.S. Pat. No. 5,681,215, which is incorporated herein by reference. In such systems, a retaining ring and associated carrier ring are configured to independently move toward or away from a polishing pad surface, and in relation to each other. In this way, a retaining ring may be adjusted to a position where it contacts the polishing pad during the polishing process, thus reducing the potential for substrate slippage. Using such a system, a head assembly and accompanying substrate may be brought into close proximity with a polishing pad, with the retaining ring adjusted such that it contacts the polishing pad prior to the substrate. Once the retaining ring contacts the polishing pad, the carrier plate may be independently adjusted relative to the polishing pad so as to create a desired amount of pressure between the substrate lower surface (or surface to be polished) and the polishing pad surface.

One disadvantage encountered with conventional CMP systems is lack of substrate edge profile control during the CMP process. Polishing slurry distribution and profile of the polishing pad under pressure play major roles in the post-CMP film thickness profile of a semiconductor substrate. Although attempts have been made to address edge profile effects due to slurry distribution and polishing pad profile, these improvements have not been sufficient to fulfill tighter requirements for new submicron device technology.

FIG. 1 illustrates a conventional CMP polishing apparatus having a rotating platen 10 supporting a polishing pad 12 which is adhered thereto. A slurry layer 14 (containing, for example, a reactive agent such as water, abrasive particles such as silicon dioxide, and a chemically reactive catalyzer such as potassium hydroxide) may be provided on the upper surface of polishing pad 12 by a slurry introduction point 16. A head assembly 11 having independent acting carrier plate 18 and retaining ring 20 is provided to contain and support substrate 22 against upper surface of polishing pad 12 for polishing. Vacuum ports 24, or other mechanism for holding substrate 22 to carrier plate 18 may be provided. As shown by the arrows in FIG. 1, platen 10 and head assembly 11 are capable of separate motion. For example, platen 10 and head assembly 11 may rotate in the same direction, but at different speeds. Furthermore, head assembly 11 may be capable of lateral or back and forth motion.

As shown in FIG. 1, retaining ring 20 acts to hold and contain substrate 22 in place relative to carrier plate 18 during the differential movement of platen 10 relative to head assembly 11. The lower (or pad side) surface of retaining ring 20 extends toward polishing pad 12 beyond the lower (or pad side) surface of substrate 22, thus contacting and depressing the upper (or polishing side) surface of polishing pad 12 around the outer periphery of substrate 22. Movable carrier plate 18 may then be adjusted independent of the retaining ring 20 to apply the desired pressure between substrate 22 and polishing pad 12.

FIG. 2 is a simplified illustration of a conventional retaining ring 20, inverted to show smooth lower (or pad side) surface 30. FIG. 3 shows the interrelation between polishing pad 12, substrate 22 and conventional smooth-surfaced retaining ring 20 during polishing using a conventional CMP process. As may be seen in FIG. 3, the upper (or polishing side) surface of pad 12 experiences pressure from both substrate 22 and retaining ring 20 resulting in pressure discontinuities at the outer peripheral edge of substrate 22 and inner peripheral edge of retaining ring 20. The combination of these effects tends to cause the upper surface of pad 12 near the outer edge of substrate 22 to be wrinkled or bowed as shown in FIG. 3, reducing the "contact area" between upper surface of pad 12 and lower (or pad side) surface 23 of substrate 22 during polishing. This phenomenon typically causes the during-polishing profile to result in over-polishing of the flat-zone area (i.e., the area near the center of the substrate), while under-polishing the edge areas 32 of substrate 22 (i.e., the edge of the substrate 22 adjacent the retaining ring 20). Such over and underpolishing results in decreased uniformity of, for example, semiconductor substrates due to thinner film at the center of substrate 22 and/or thicker film at the edge of substrate 22. Decreased uniformity adversely affects semiconductor fabrication criteria, such as performance during etch and photo processes, as well as device yield.

SUMMARY OF THE INVENTION

The disclosed methods and apparatus provide CMP retaining rings having outwardly inclined surface characteristics which improve substrate removal rate and/or removal uniformity during CMP processing operations. Surprisingly, improved polishing characteristics are achieved by the interaction between outwardly inclined surface features of the disclosed CMP retaining rings with a CMP polishing pad during polishing.

In the practice of the disclosed methods and apparatus, a retaining ring may be provided with outwardly inclined surface characteristics on the lower (or pad-side) surface of the retaining ring which are capable of flattening the upper (or polishing-side) surface of the polishing pad beneath a substrate during polishing. Relative to the direction of relative rotation between polishing pad and retaining ring, the outwardly inclined surface characteristics may have a leading edge defined at or adjacent the inside periphery of the retaining ring, and a trailing edge defined at or adjacent the outside periphery of the retaining ring. A surface characteristic profile may be defined to extend between the leading and trailing edges. As so configured, the outwardly inclined surface characteristics act to provide a pushing and stretching action on the pad during polishing in such a way as to flatten the upper surface of the polishing pad underneath the polishing head assembly, and underneath the substrate undergoing polishing. The surface features may be provided as intermittent or discontinuous recessed and/or protruding areas on the lower surface of the CMP retaining ring.

Advantageously, the disclosed retaining ring surface characteristics result in a flattened polishing pad upper surface and improved edge profile and related thickness uniformity of a substrate undergoing polishing. These advantages may be achieved with no requirement for retaining ring break in. Furthermore, head-to-head variation related to wafer edge may be reduced on a multi-head machine. Other benefits include improved flat-zone performance (i.e., not over-polishing the flat-zone area of a semiconductor wafer substrate while at the same time not under-polishing outer periphery area of the substrate). This translates into improved wafer level and di-level planarity with less pattern density dependency.

Further advantageously, CMP polishing systems having retaining rings with the disclosed outwardly inclined surface characteristics may be used to achieve higher polishing rate and improved throughput. These features are believed to be achieved, in part, by the interaction of the surface characteristics of the disclosed retaining rings and a polishing pad upper surface. For example, in one embodiment, relatively sharp edges of surface features of a retaining ring may be used to condition the pad and enhance slurry transport.

In one respect, disclosed is a CMP retaining ring including an inner peripheral surface; an outer peripheral surface; and first surface characteristics defined on a lower surface of the retaining ring and extending from a position at or adjacent the inner peripheral surface of the retaining ring, to a position at or adjacent the outer peripheral surface of the retaining ring. The lower surface of the retaining ring may be adapted to contact and depress an upper surface of a polishing pad during chemical mechanical polishing of a lower surface of a substrate contained within the inner peripheral surface of the retaining ring during chemical mechanical polishing, and the first surface characteristics may be adapted to flatten the upper surface of the pad disposed within the inner peripheral surface of the retaining ring during the chemical mechanical polishing of the lower surface of the substrate, such that a contact area between the upper surface of the pad and the lower surface of the substrate may be increased. The lower surface of the retaining ring may be inwardly or outwardly tapered. The first surface characteristics may include partially extending surface characteristics. The first surface characteristics may be adapted to impart tension to the upper surface of the pad during the chemical mechanical polishing of the substrate, the tension being in an outward direction toward the inner peripheral surface of the retaining ring such that the upper surface of the pad may be flattened. The first surface characteristics may be outwardly inclined relative to the direction of relative rotation between the lower surface of the retaining ring and the upper surface of the pad.

The first surface features may include a plurality of protrusions, recesses, or mixture thereof; the first surface features being outwardly inclined relative to the direction of relative rotation between the lower surface of the retaining ring and the upper surface of the pad to impart dynamic peripheral stretching action to the upper surface of the pad in a direction away from a portion of the pad adjacent the substrate toward a portion of the pad in contact with the lower surface of the retaining ring. The first surface features may include a plurality of recesses, the recesses being defined as at least one of grooves, dimples, or a mixture thereof. The first surface features may include a plurality of protrusions, the protrusions being defined as at least one of ridges, bumps, raised points, or a mixture thereof. The first surface characteristics may include a plurality of recesses, each of the recesses including a grooved profile defined in the lower surface of the retaining ring and extending from a leading edge defined at the inner peripheral surface of the retaining ring to a trailing edge at the outer peripheral surface of the retaining ring.

A grooved profile may define an arcuate shape between the leading and trailing edges. The arcuate shape may be defined to have a radius of from about 55% to about 65% of an interior peripheral radius of the retaining ring as measured from a center point located on a circle having a radius of from about 70% to about 75% of the interior peripheral radius of the retaining ring as measured from a center point of the retaining ring. A grooved profile may have an angled edge fillet defined on a backside surface of the groove. The angled edge fillet may be adapted to impart increased dynamic peripheral stretching action to the upper surface of the pad by increasing dynamic frictional forces between the surface features and the upper surface of the pad during chemical mechanical polishing.

A retaining ring may further include second surface characteristics defined on the lower surface of the retaining ring and extending from a position at or adjacent the outer peripheral surface of the retaining ring, to a position at or adjacent the inner peripheral surface of the retaining ring; the second surface characteristics including a plurality of protrusions or recesses inwardly inclined relative to the direction of relative rotation between the lower surface of the retaining ring and the upper surface of the pad. The first and second surface characteristics may include a plurality of recesses, each of the recesses including a grooved profile defined in the lower surface of the retaining ring; the outwardly inclined first grooved surface characteristics extending from a leading edge defined at the inner peripheral surface of the retaining ring to a trailing edge at the outer peripheral surface of the retaining ring; and the inwardly inclined second grooved surface characteristics extending from a leading edge defined at an outer peripheral surface of the retaining ring to a trailing edge defined at an inner peripheral surface of the retaining ring.

A retaining ring may include at least one first material; and the first surface features may include at least one second material to form first surface features of composite construction. In one embodiment, the first surface features of composite construction may include a plurality of recesses, each of the recesses including a grooved profile defined in the lower surface of a retaining ring that is comprised of polyphenylsulfide; and in which the backside of a grooved profile is comprised of carbide.

In another respect, disclosed is a CMP head assembly, including a carrier plate adapted to apply downward pressure to a substrate so that a lower surface of the substrate may be pressed against an upper surface of a polishing pad during chemical mechanical polishing; a retaining ring adapted to contain the substrate within an inner peripheral surface of the retaining ring during the chemical mechanical polishing, the retaining being adjustably mounted to the carrier plate and having a lower surface adapted to apply a downward pressure to the upper surface of the polishing pad independent of the downward pressure applied to the upper surface of the polishing pad by the carrier plate; and first surface characteristics defined on a lower surface of the retaining ring and extending from a position at or adjacent the inner peripheral surface of the retaining ring, to a position at or adjacent the outer peripheral surface of the retaining ring; wherein the first surface characteristics may be adapted to impart a dynamic peripheral stretching action to the upper surface of the pad during the chemical mechanical polishing, such that the pressure uniformity between the upper surface of the pad and the lower surface of the substrate may be increased.

A CMP head assembly may have first surface characteristics that are outwardly inclined relative to the direction of relative rotation between the lower surface of the retaining ring and the upper surface of the pad. The first surface features may include a plurality of recesses, protrusions, or a combination thereof; wherein the recesses may be defined as at least one of dimples, grooves, or a mixture thereof; and wherein the protrusions may be defined as at least one of ridges, bumps, raised points, or a mixture thereof. The first surface characteristics may include a plurality of recesses, each of the recesses including a outwardly inclined grooved profile defined in the lower surface of the retaining ring and extending from a leading edge defined at the inner peripheral surface of the retaining ring to a trailing edge at the outer peripheral surface of the retaining ring. A grooved profile may define an arcuate shape between the leading and trailing edges. A grooved profile may have an angled edge fillet defined on a backside surface of the groove. A grooved profile may define an arcuate shape between the leading and trailing edges, and a grooved profile may have an angled edge fillet defined on a backside surface of the groove.

A CMP head assembly may further include second surface characteristics defined on the lower surface of a retaining ring and extending from a position at or adjacent the outer peripheral surface of the retaining ring, to a position at or adjacent the inner peripheral surface of the retaining ring; the second surface characteristics including a plurality of grooved profile recesses inwardly inclined relative to the direction of relative rotation between the lower surface of the retaining ring and the upper surface of the pad; each of the inwardly inclined grooved profiles intersecting one of the outwardly inclined grooved profiles. The retaining ring may comprise at least one first material; and the first surface features may comprise at least one second material to form first surface features of composite construction. The retaining ring may comprise polyphenylsulfide; and a backside of a grooved profile may comprise carbide.

In another respect, disclosed is a method of chemical mechanical polishing a substrate, including positioning a lower surface of the substrate in contact with an upper surface of a CMP polishing pad, and within an inner peripheral surface of a CMP retaining ring; positioning a lower surface of the CMP retaining ring in contact with the upper surface of the CMP polishing pad; and rotating the CMP retaining ring, the upper surface of the CMP polishing pad or both, so as to achieve a relative rotation between the lower surface of the CMP retaining ring and the upper surface of the polishing pad; wherein the retaining ring may includes first surface characteristics defined on a lower surface of the retaining ring, and wherein the first surface characteristics may be outwardly inclined relative to the direction of relative rotation between the lower surface of the retaining ring and the upper surface of the pad. The first surface characteristics may include partially extending surface characteristics. The first surface characteristics may be adapted to flatten the upper surface of the pad disposed within the inner peripheral surface of the retaining ring during the chemical mechanical polishing of the lower surface of the substrate, such that a contact area between the upper surface of the pad and the lower surface of the substrate may be increased. The first surface characteristics may be adapted to impart tension to the upper surface of the pad during the chemical mechanical polishing of the substrate, the tension being in an outward direction toward the inner peripheral surface of the retaining ring such that the upper surface of the pad may be flattened.

In this method, the first surface features may include a plurality of protrusions, recesses, or mixture thereof; the first surface features being outwardly inclined relative to the direction of relative rotation between the lower surface of the retaining ring and the upper surface of the pad to impart dynamic peripheral stretching action to the upper surface of the pad in a direction away from a portion of the pad adjacent the substrate toward a portion of the pad in contact with the lower surface of the retaining ring. The first surface features may include a plurality of recesses, protrusions, or a combination thereof; wherein the recesses may be defined as at least one of grooves, dimples, or a mixture thereof; and wherein the protrusions may be defined as at least one of ridges, bumps, raised points, or a mixture thereof. The first surface characteristics may include a plurality of recesses, each of the recesses including a outwardly inclined grooved profile defined in the lower surface of the retaining ring and extending from a leading edge defined at the inner peripheral surface of the retaining ring to a trailing edge at the outer peripheral surface of the retaining ring.

In this method, a grooved profile may define an arcuate shape between the leading and trailing edges. A grooved profile may have an angled edge fillet defined on a backside surface of the groove. A grooved profile may define an arcuate shape between the leading and trailing edges, and a grooved profile may have an angled edge fillet defined on a backside surface of the groove. Second surface characteristics may further be defined on the lower surface of the retaining ring and extending from a position at or adjacent the outer peripheral surface of the retaining ring, to a position at or adjacent the inner peripheral surface of the retaining ring; the second surface characteristics including a plurality of grooved profile recesses inwardly inclined relative to the direction of relative rotation between the lower surface of the retaining ring and the upper surface of the pad; each of the inwardly inclined grooved profiles intersecting one of the outwardly inclined grooved profiles.

In this method, the retaining ring may include at least one first material; and the first surface features may include at least one second material to form first surface features of composite construction. The retaining ring may comprise polyphenylsulfide; and a backside of a grooved profile may comprise carbide.

DESCRIPTION OF ILLUSTRATIVE EMBODIMENTS

The disclosed methods and apparatus may be employed with any CMP processing system in which a CMP retaining ring contacts a CMP polishing pad during the polishing process. Examples of such polishing systems include, but are not limited to, polishing systems having independently acting CMP retaining rings and carrier plates such as Mirra (available from Applied Materials), Strasbaugh, SpeedFam, etc. Further information on such systems may be found in U.S. Pat. No. 5,681,215, which is incorporated herein by reference.

Examples of CMP applications in which the disclosed method and apparatus may be employed include any CMP application involving the removal of material from the surface of the semiconductor wafer or other type of substrate. As used herein, "substrate" includes any semiconductor substrate including, but not limited to, a semiconductor wafer substrate such as silicon or GaAs. It will be understood that a "substrate" may include, among other things, a semiconductor wafer or semiconductor wafer having various process layers formed on the wafer. As used herein, "layer" may be used interchangeably with "film." For example, in one exemplary embodiment, the disclosed method and apparatus may be employed in the CMP polishing of borophosphosilicate glass ("BPSG") layers for 64M SDRAM products to improve photoprocess and device yield. Other exemplary applications include, but are not limited to, 64M SDRAM STI-CMP processes and any CMP process including tungsten, copper, polysilicon, aluminum, oxide, and mixtures thereof.

Figure 4:
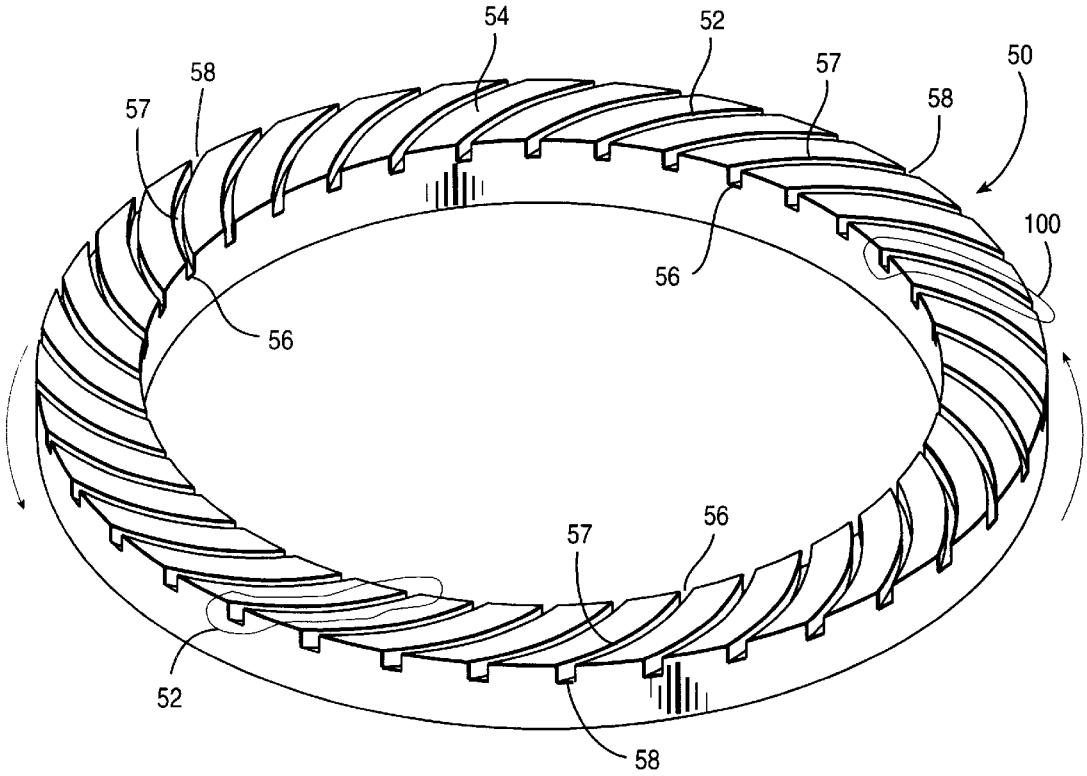
FIG. 4 is a simplified perspective view of a CMP retaining ring having arcuate grooved surface characteristics according to one embodiment of the disclosed method and apparatus.
Figure 5:
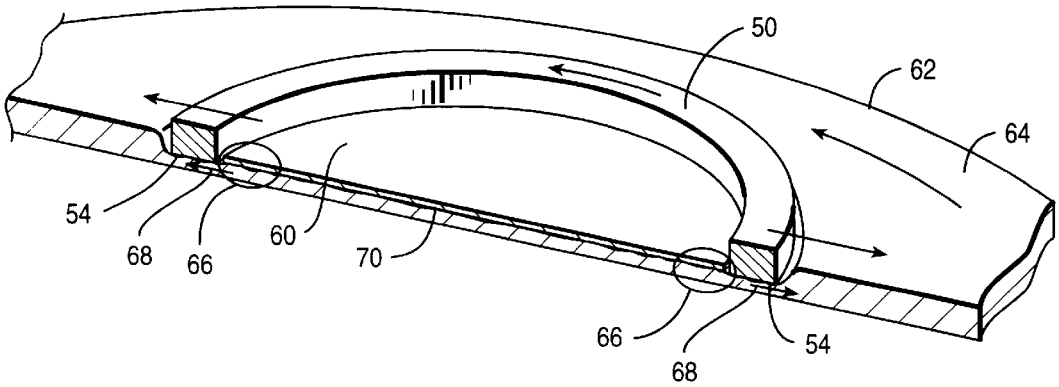
FIG. 5 is a simplified and partial perspective view of a CMP retaining ring having grooved surface characteristics according to one embodiment of the disclosed method and apparatus, and shown in use during CMP polishing of a semiconductor substrate.

FIG. 4 illustrates one exemplary embodiment of a CMP retaining ring 50 having arcuate grooved surface characteristics 52 defined on the lower (or pad-side) surface 54 of retaining ring 50. FIG. 5 shows the retaining ring 50 of FIG. 4 in use for CMP polishing a substrate 60. During polishing, lower surface 54 of retaining ring 50 contacts the upper (or polishing) surface 64 of CMP polishing pad 62 during the polishing process. As illustrated, during polishing retaining ring 50 contains and maintains substrate 60 in position contacting the upper surface 64 of CMP polishing pad 62, and in position between polishing pad surface 64 and a CMP carrier plate (not shown).

As illustrated in FIG. 5, during the polishing process, polishing pad 64 and/or the CMP head assembly may be rotated so that the carrier plate (not shown), substrate 60 and retaining ring 50 rotate in a manner relative to polishing pad 64 as previously described. Directions of rotation of pad 62 and the head assembly may be opposite or may be the same (such as indicated by the arrows), and/or may be on the same or different axis of rotation. Alternatively, only one of pad 62 or ring 50 may be rotated. When used in reference to pad 62 and ring 50, it will be understood that by "relative rotation" it is meant the difference in relative rotational motion between upper surface of pad 62 and lower surface of ring 50, resulting from combined motion of pad 62 and/or ring 50. At the same time, the head assembly may move in a side-to-side and/or back and forth lateral manner relative to pad 62 as illustrated by the arrows in FIG. 5. It will be understood with benefit of this disclosure, that any other combination of motions of a head assembly and substrate 60 relative to a polishing pad 62 may occur including, but not limited to, rotation of only one of the head assembly or polishing pad 62 and/or rotation of either or both head assembly and polishing pad 62 without lateral motion of the head assembly. Furthermore, elliptical and/or both side-to-side and back and forth motions of the head assembly relative to pad 62 may be employed.

Returning to FIG. 3, during a conventional CMP process regions of lower pad/substrate pressure 32 and 33 are created from the inner peripheral edge of retaining ring 20 inwards toward the center of substrate 22, and where a gap exists at the periphery extends up to at least the point where upper surface 15 of polishing pad 12 contacts substrate 22, as shown. Due to reduced pad/substrate pressure in areas 32 and 33, pressure uniformity across the surface of substrate 22 is decreased, and in some extreme cases gaps between the pad and substrate may form (as shown). While not wishing to be bound by theory, it is believed that undesirable areas of reduced pad/substrate pressure 32 and 33 present when a conventional smooth surface retaining ring 20 is employed to polish a substrate 22, result from at least one of two deflection forces. A static deflection force may be caused by rigidity effects of polishing pad upper surface 15 when depressed or indented by smooth surface 30 of conventional retaining ring 20. In reduced pressure areas 32 and 33, rigidity of upper surface 15 maintains separation and/or transmits lower pressure between upper surface 15 and substrate 22 for a distance inward which may depend on a number of factors such as rigidity of surface 15, pressure applied by retaining ring 20 and/or substrate 22 to pad surface 15 and distance between smooth surface 30 of retaining ring 20 and lower (or pad-side) surface 23 of substrate 22 relative to pad surface 15.

A dynamic deflection of pad surface 15 may occur in addition to, or in alternative to, a static deflection force when head and platen are rotating. In such a case, the trailing edge of the leading inner periphery of retaining ring 20 adjacent the direction in which the head assembly is moving across polishing pad 12 cuts into and deflects polishing pad surface 15 downward, as shown by gap area 32. The leading side of the trailing inner periphery of retaining ring 20 located away from the direction in which the head assembly is moving across polishing pad 12 also cuts into and deflects polishing pad surface 15 downward in area 33. On the inner periphery of the leading side of retaining ring 20, dynamic deflection characteristics may add to static deflection forces previously described to further extend the length of reduced pressure area 32 (or point where pad surface 15 recovers pressure and/or contacts substrate lower surface 23). Similarly, reduced pressure area 33 may actually be reduced in length at the inner periphery of the trailing side of conventional retaining ring 20 by virtue of, for example, a raised area of pad surface 15 immediately adjacent the inner periphery of the trailing side of retaining ring 20, as shown.

Figure 1:
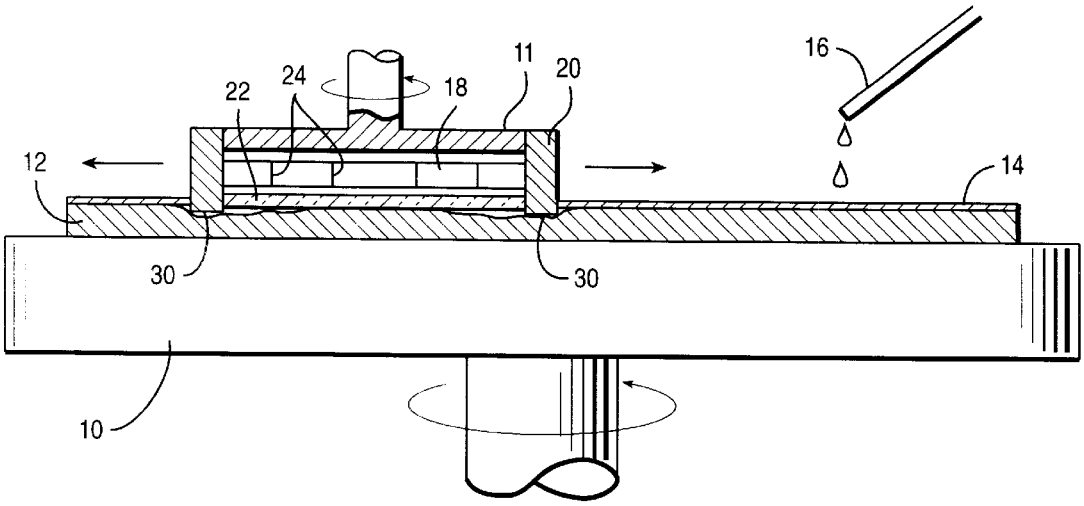
FIG. 1 is a simplified sectional view of a conventional chemical mechanical polishing system having independently acting retaining ring and carrier plate mechanisms.
Figure 2:
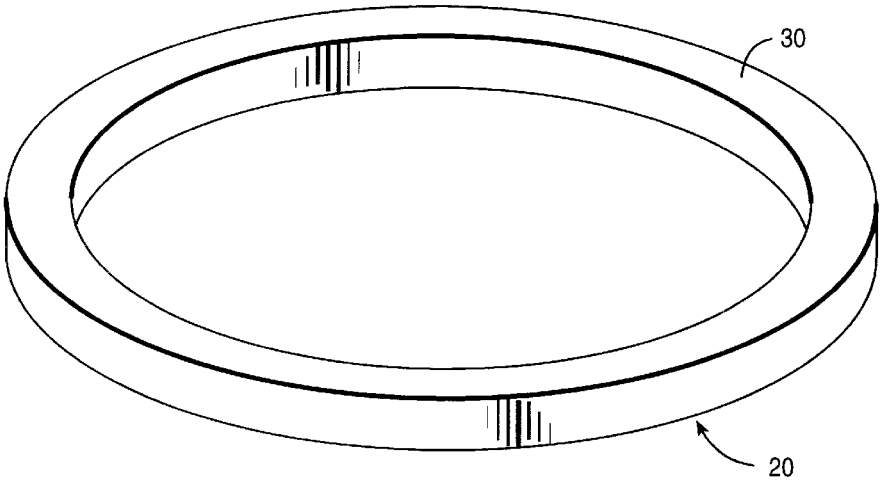
FIG. 2 is a simplified perspective view of a conventional CMP retaining ring.
Figure 3:
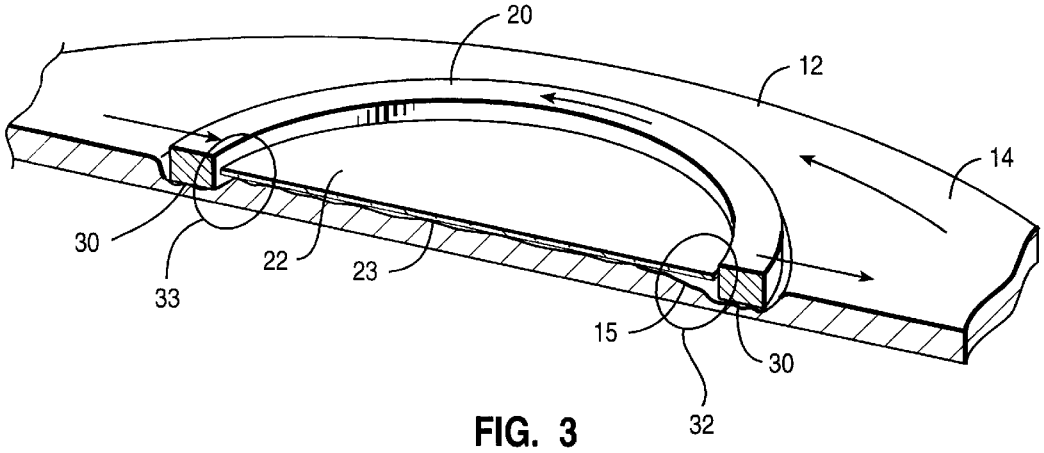
FIG. 3 is a simplified and partial perspective view of a conventional CMP retaining ring, shown in use during CMP polishing of a semiconductor substrate.

In contrast to FIG. 3, retaining rings having the disclosed outwardly inclined surface characteristics act to increase polishing uniformity by reducing or substantially eliminating regions of lower pad/substrate pressure 32 and 33. This phenomenon may be referred to as an increase in pad/substrate pressure uniformity, as distribution of pad pressure across substrate surface 70 is more uniform. Referring now to FIG. 5, arcuate grooved surface features 52 on the lower (or pad-side) surface 54 of retaining ring 50 interact with the upper (or polishing) surface 64 of polishing pad 62 during polishing in a manner so as to stretch upper surface 64 of polishing pad 62, making it flatter beneath substrate 60 at edge areas 66. Stretching action is imparted to upper surface 64 of pad 62 by virtue of tension imparted to upper surface 62 in an outward direction away from center of substrate 60 and toward the periphery of retaining ring 50, as shown by arrows 68. In this manner, contact and equal downforce or pad/substrate pressure is maintained between upper surface 64 of polishing pad 62 and lower surface 70 of substrate 60 up to, or nearly up to the exterior or peripheral edge of substrate 60 as may be seen in edge areas 66. Consequently, contact area between lower surface 70 of substrate 60 is increased, and uniform polishing action is achieved across substantially all of the bottom surface 70 of substrate 60, including in the flat zone 66, thus achieving improved edge profile thickness uniformity.

Still referring to FIG. 5, both static and dynamic deflection forces are counteracted by virtue of outward tension applied to pad surface 64 which acts to straighten or flatten the surface 64 of polishing pad 62 located within the periphery of ring 50. Tension forces applied to pad surface 64 are imparted by virtue of the disclosed retaining ring surface characteristics when the retaining ring rotates in contact with the pad.

As shown in FIG. 4, each of arcuate grooved surface characteristics 52 is outwardly inclined towards the differential direction of ring/pad rotation shown by the arrows. Each of outwardly inclined surface characteristics 52 has a leading edge 56 and a trailing edge 58 connected by a surface characteristic profile 57 inclined such that each of the leading edges 56 precedes its associated trailing edge 58 when the relative rotation between the lower (or pad-side) surface 54 of retaining ring 50 and the upper (or polishing) surface 64 of polishing pad 62 is in the direction indicated by the arrow. As a consequence, each outwardly inclined surface characteristic 52 contacts and grabs, or otherwise frictionally interrelates with, a pad surface 64 to stretch, pull or otherwise displace, polishing pad surface 64 outwards toward the outer periphery of the retaining ring 50 by virtue of the dynamic movement of the inclined surface characteristic 52 against pad surface 64. This stretching action is referred to herein as "dynamic peripheral stretching."

As used herein, "inclined surface characteristic profile" includes surface characteristic profiles having linear, arcuate or variable profile shapes between the leading and trailing edges of a surface characteristic. Variable profile shapes include, but are not limited to, combinations of linear and arcuate profiles, combinations of different arcuate profiles, irregular profiles (e.g., non-linear and non-arcuate), etc. "Outwardly inclined surface characteristic profile" refers to a surface characteristic profile having a leading edge defined at the inside periphery of a retaining ring, and a corresponding trailing edge defined at the outside periphery of the ring, with said leading and trailing edges being defined relative to the direction of relative rotation between a lower surface of a retaining ring and an upper surface of a polishing pad, such that a leading edge precedes the corresponding trailing edge of the same profile relative to the upper surface of the polishing pad when rotated in the direction of the relative rotation. "Inwardly inclined surface characteristic profile" refers to a surface characteristic profile having a leading edge defined at the outside periphery of a retaining ring, and a corresponding trailing edge defined at the inside periphery of the ring, with the leading and trailing edges being defined relative to direction of ring/pad relative rotation as before. It will be understood with benefit of this disclosure that a leading or trailing edge is considered "defined at" a given periphery of a retaining ring when it is the portion of a surface characteristic profile disposed closest the given periphery, whether the surface characteristic profile actually intersects the given periphery of the ring, or has an end that is merely defined adjacent the periphery.

The amount of outward tension applied to a polishing pad surface 64 by surface characteristics 52 may depend on a number of factors, for example, pressure of retaining ring 50 against pad surface 64, relative rotational speed between retaining ring 50 and pad surface 64, severity or steepness of incline of surface characteristics 52, shape or contour of surface characteristics 52, number and density of surface characteristics 52, etc. Thus, with benefit of this disclosure, those of skill in the art will understand that number and dimension of surface characteristics may be varied to obtain optimum tension to fit individual circumstances and polishing pad materials.

Figure 6:
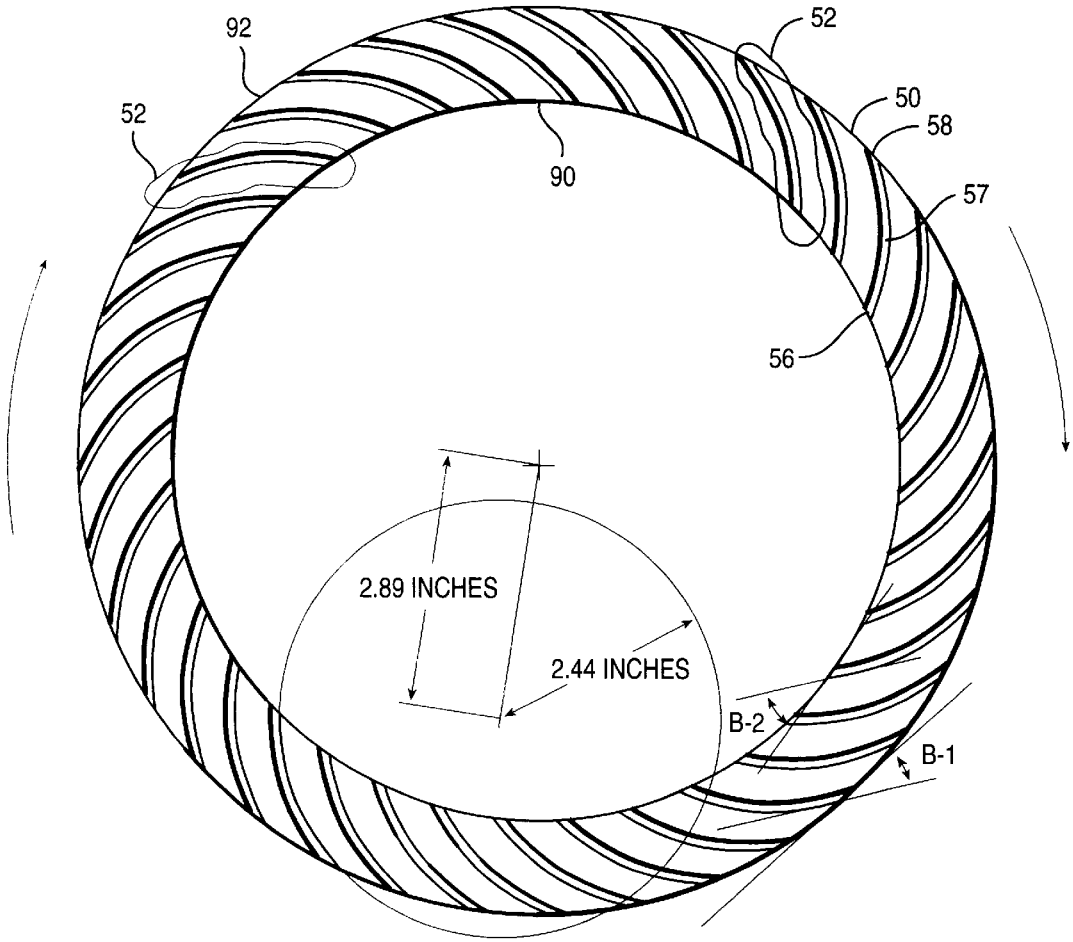
FIG. 6 is a simplified overhead view of a CMP retaining ring having arcuate grooved surface characteristics according to one embodiment of the disclosed method and apparatus.

FIG. 6 illustrates one exemplary embodiment of a retaining ring 50 having arcuate-shaped outwardly inclined surface characteristics 52, such as the arcuate grooved surface characteristics of ring 50 pictured in FIG. 4. Each of outwardly inclined surface characteristics 52 have a leading edge 56 defined at the interior peripheral wall 90 of retaining ring 50 and a trailing edge 58 defined at exterior peripheral wall 92 of retaining ring 50. An arcuate-shaped profile 57, for example a groove or trench as shown in FIG. 4, is defined between each leading edge 56 and trailing edge 58 as shown. In the exemplary embodiment illustrated in FIG. 6, 36 surface characteristics (e.g., grooves) may be defined in a retaining ring having an interior peripheral diameter of about 8" and an exterior peripheral diameter of about 10", and thus configured for holding an 8" diameter semiconductor wafer. Surface characteristics, including grooved surface characteristics may be configured of varying width and depth. In the exemplary embodiment of FIG. 6, each grooved surface characteristic has a width of about ¼" and a depth of about ¼", as those terms are further defined below.

Dimensions may be expressed in terms of individual surface characteristics (e.g., dimensions of individual intermittent bumps, dimples, etc), or in terms of overall surface characteristic profile dimensions (e.g., overall dimensions of a profile comprised of multiple intermittent characteristics, or overall dimensions of a profile comprised of a single characteristic such as a groove or ridge).

Figure 8:
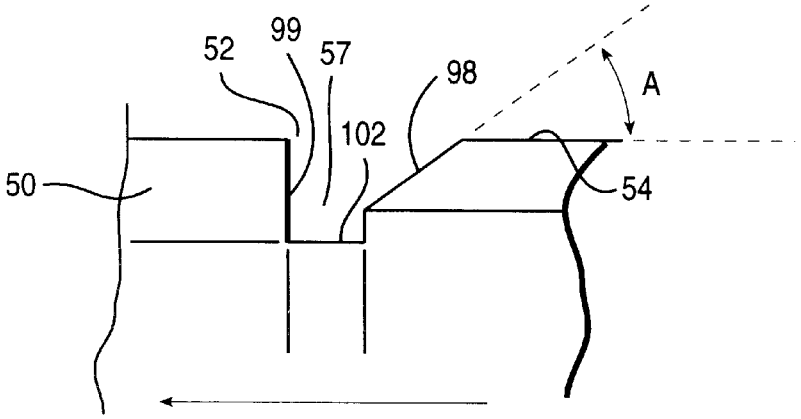
FIG. 8 is a simplified sectional view of a section of a CMP retaining ring having grooved surface characteristics according to one embodiment of the disclosed method and apparatus.
Figure 8A:
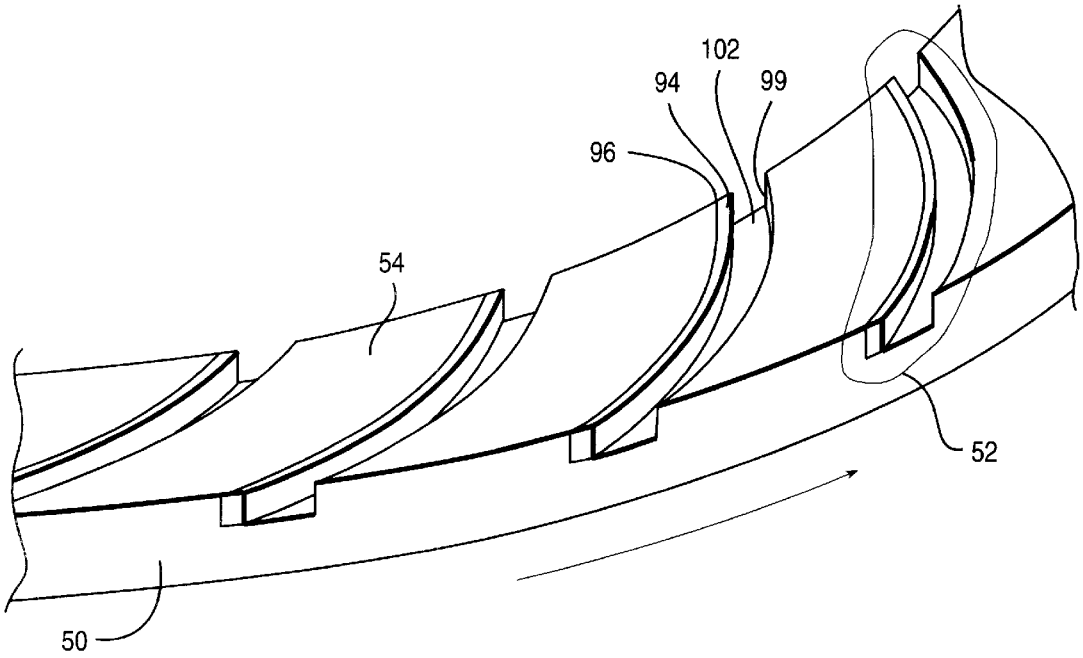
FIG. 8A is a simplified sectional view of a section of a CMP retaining ring having grooved surface characteristics according to one embodiment of the disclosed method and apparatus.
Figure 8B:
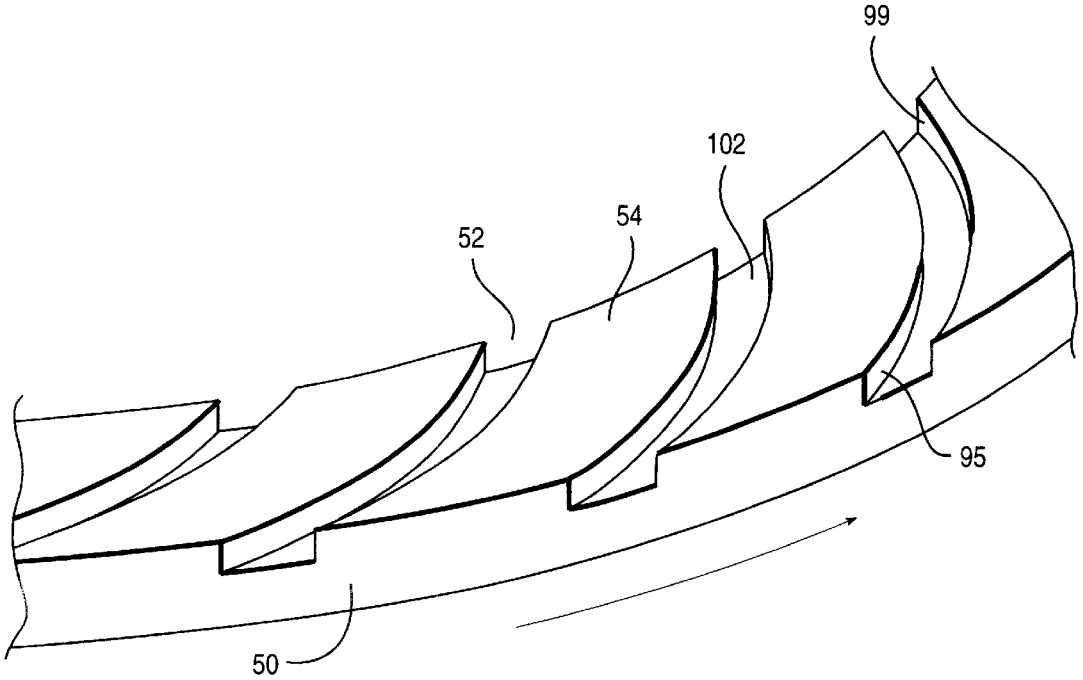
FIG. 8B is a simplified sectional view of a section of a CMP retaining ring having grooved surface characteristics according to one embodiment of the disclosed method and apparatus.

As used herein, "width" of a surface characteristic or surface characteristic profile, be it raised and/or recessed in nature, is defined as the horizontal distance between front and back boundaries of an individual surface characteristic (e.g., between frontside 99 and backside 95 surfaces of a grooved surface characteristic 52 shown in FIG. 8B). In one embodiment, width of a grooved surface characteristic profile for use with a CMP retaining ring configured to polish an 8" semiconductor wafer may be from about ⅛" to about ½", although greater or lesser width values, as well as width values that vary within an individual surface characteristic profile are also possible.

Figure 14:
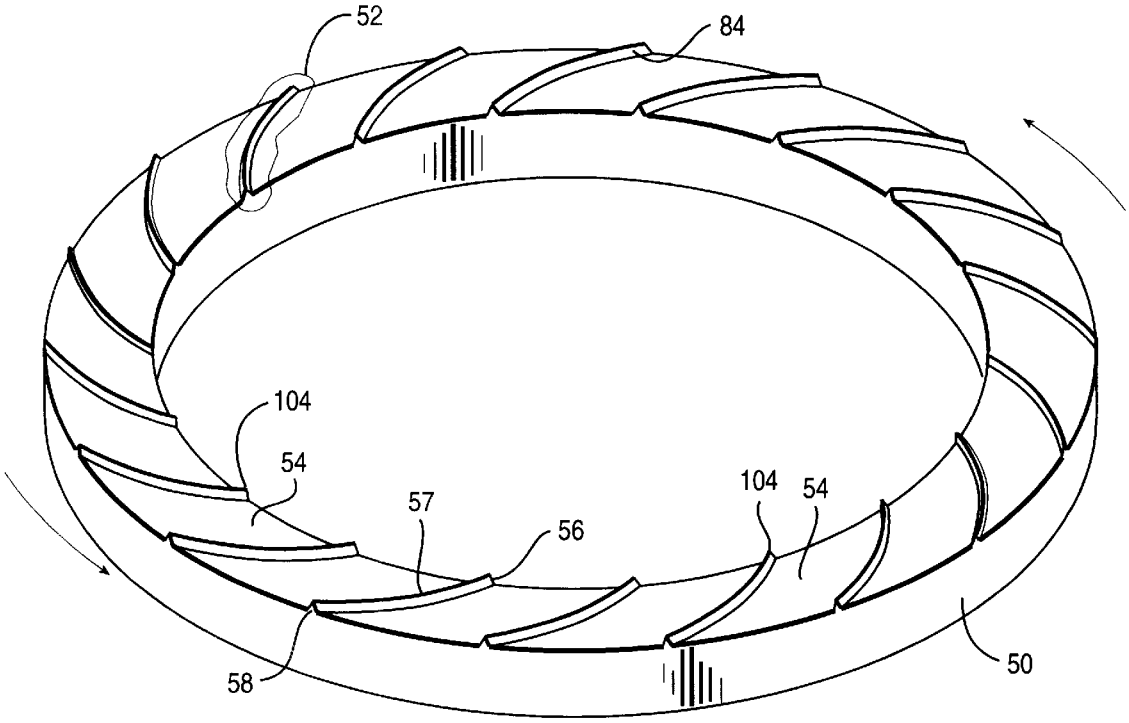
FIG. 14 is a simplified perspective view of a CMP retaining ring having arcuate ribbed surface characteristics according to one embodiment of the disclosed method and apparatus.
Figure 18:
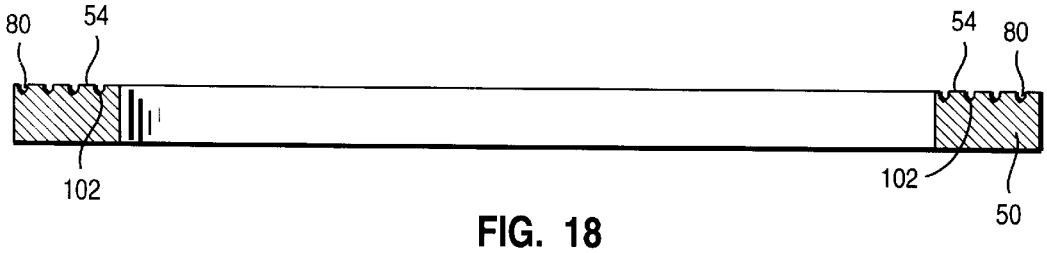
FIG. 18 is a simplified cross sectional view of the CMP retaining ring of FIG. 12.
Figure 19:
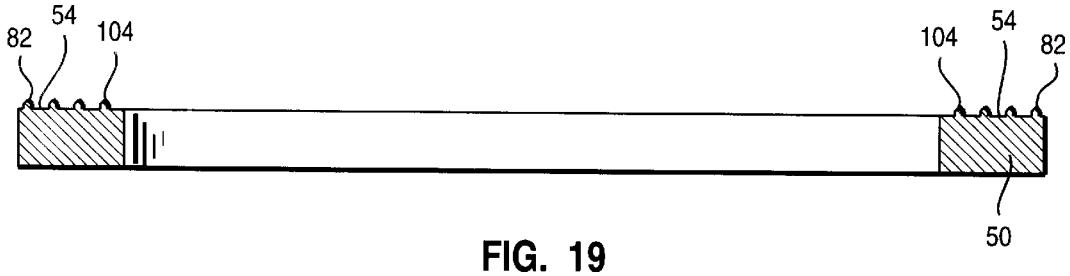
FIG. 19 is a simplified cross sectional view of a CMP retaining ring of FIG. 13.

As used herein, depth of a recessed surface characteristic or surface characteristic profile is defined as the vertical distance between a lower or padside surface 54 of a retaining ring to the boundary of the recessed surface characteristic farthest from surface 54 (e.g., the vertical distance between surface 54 and base 102 of a grooved or dimpled surface characteristic as shown in FIG. 8B and FIG. 18). Height of a raised surface characteristic or surface characteristic profile is similarly defined as the vertical distance between a lower or padside surface 54 of a retaining ring to the boundary of the raised surface characteristic farthest from surface 54 (e.g, the vertical distance between surface 54 and top or apex 104 of a raised surface characteristic as shown in FIG. 14 and FIG. 19).

In one embodiment, depth of a grooved surface characteristic profile for use with a CMP retaining ring configured to polish an 8" semiconductor wafer may be from about ⅛" to about ½". In another embodiment having raised surface characteristics, similar height dimensions are possible. In either case, greater or lesser values of depth or height, as well as values of depth or height that vary within an individual surface characteristic profile, are also possible. Mixtures of recessed and raised surface characteristics on the same retaining ring, or even within the same surface characteristic profile, are also possible as well. Similar surface characteristic widths, depths and heights that are employed for 8" rings may be employed for 12" rings as well, although widths, depths and heights of other dimensions are also possible.

Although retaining ring 50 of this embodiment is for use with an 8" semiconductor wafer, it will be understood that the disclosed method and apparatus may be employed with retaining rings sized and configured for polishing substrates having other diameters (e.g., semiconductor wafers and other substrates having diameters of 12", 6", 4", etc.), including any other type of substrate other than a semiconductor wafer that may be polished employing retaining rings and polishing pads in a manner similar to CMP methods described herein. Furthermore, it will be understood that the number of surface characteristic profiles employed in any particular application may vary as desired. For example, another exemplary embodiment of the disclosed method and apparatus used to polish 8" semiconductor wafers may employ 30 profiles (e.g., grooves) in a CMP retaining ring having the same dimensions as the ring illustrated in FIG. 6.

The arcuate-shaped surface characteristics illustrated on the 8" I.D. retaining ring of FIG. 6 correspond to one exemplary embodiment in which arcuate outwardly inclined profiles 52 have a radius of from about 55% to about 65% of the interior peripheral radius of retaining ring 50 as measured from a center point located on a circle having a radius of from about 70% to about 75% of the interior peripheral radius of retaining ring 50 as measured from the center point of retaining ring 50. In the specific example illustrated in FIG. 6, arcuate-shaped profiles 52 have a radius of about 2.44" (or about 61% of the interior peripheral radius of ring 50) as measured from a center point located on a circle having a radius of about 2.89" (or about 72% of the interior peripheral radius of ring 50) from the center point of retaining ring 50. It will be understood that this relationship may be used for retaining rings having interior peripheral diameters greater than or less than 8" nominal and having surface characteristics of recessed or protruding configuration. It will also be understood that this relationship is only exemplary, and that radii values outside either or both of the percentage ranges given above are also possible.

Still referring to FIG. 6, surface characteristic profiles may also be described as having shapes which intersect the tangent of the inner and outer peripheral surfaces of a retaining ring 50 at a given angle. For example, angle B-1 represents the angle at which the tangent of an arcuate profile 57 intersects the tangent of the outer periphery of retaining ring 50. Likewise, angle B-2 represents the angle at which the tangent of an arcuate profile 57 intersects the tangent of the inner periphery of retaining ring 50. For non-arcuate linear profiles, B-1 and B-2 are simply the angle that a linear profile intersects the tangent of the peripheral edges of a ring 50.

In one embodiment for arcuate shaped profiles, angle B-1 may range from about 30° to about 60°, and angle B-2 may range from about 30° to about 60°, with B-1 and B-2 being equivalent for constant arc profiles, while they may be of different value for profiles having a variable arc. In another embodiment for linear shaped profiles, angle B-1 may range from about 80° to about 100°,and angle B-2 may range from about 80° to about 100°, with B-1 and B-2 being equivalent for linear profiles, while they may be of different value for profiles having a variable linear profile.

With either linear or arcuate-shaped profiles, B-1 and B-2 may be varied, for example to provide a profile (e.g., groove) having an interior leading edge that is narrower than the exterior trailing edge, and vice-versa. In another example, for those embodiments having counter-oriented inwardly inclined slurry transfer grooves, an exterior leading edge groove that is wider than the interior trailing edge groove may be employed to assist in inward slurry transfer. It will be understood with benefit of this disclosure that the above-described angle value ranges are exemplary only, and that B-1 and/or B-2 angle values greater or less than those of these ranges may be provided. It will also be understood that a combination of linear and arcuate angles is also possible, for example linear profile angle at the exterior periphery combined with arcuate profile angle at the interior periphery, or vice-versa.

Exemplary ranges of surface characteristic profile counts employed in CMP retaining rings for polishing 8" semiconductor wafers may range from about 30 profiles to about 36 profiles. In this regard, an individual "profile" is considered to be an individual groove, ridge or other feature defined on a lower surface of a retaining ring. Such features may be defined or made up of discontinuous characteristics, for example, smaller bumps, indentations, protrusions, etc. In the figures, an individual surface feature or profile is denoted by a circle labeled 52. An exemplary range of profile counts which may be employed in CMP retaining rings for polishing 12" diameter semiconductor wafers ranges from about 44 profiles to about 52 profiles. In this regard, a CMP retaining ring for use in polishing 12" diameter semiconductor wafers may have an interior peripheral diameter of about 12" nominal and an exterior peripheral diameter of about 14". In another possible embodiment, rings of diameters other than 8" (e.g. 12", etc.) may have a number of profiles equivalent to the number of profiles given herein for 8" diameter rings, but ratioed upwards or downwards in number based on the ratio of circumference (alternatively diameter) between an 8" ring and the circumference (of diameter) of the ring in question.

It will be understood with benefit of this disclosure that the preceding profile count ranges are exemplary only, and that for any given CMP retaining ring the number of profiles may be greater or less than values within these ranges. Furthermore, it will also be understood that any of the recessed or protruding shaped surface characteristic embodiments described herein may be employed in similar number and shape as that illustrated and described in relation to FIG. 6. This includes raised surface characteristics (e.g., bumps, ridges, etc.) and recessed surface characteristics (e.g., grooves, trenches, dimples, etc.).

Figure 12:
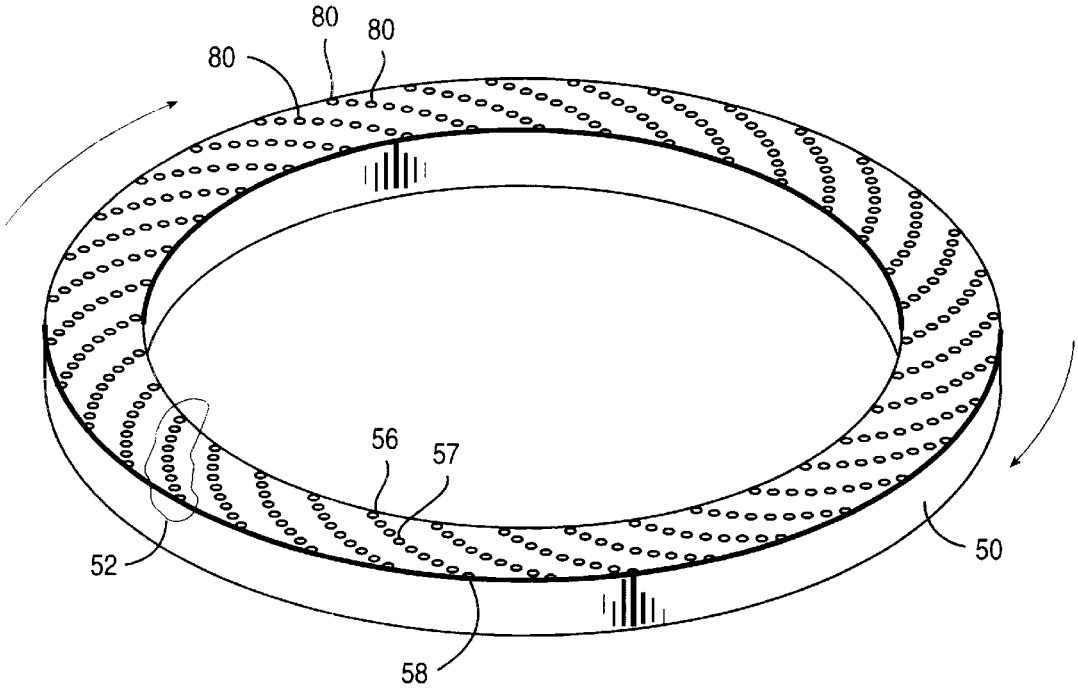
FIG. 12 is a simplified perspective view of a CMP retaining ring having arcuate dimpled surface characteristics according to one embodiment of the disclosed method and apparatus.
Figure 13:
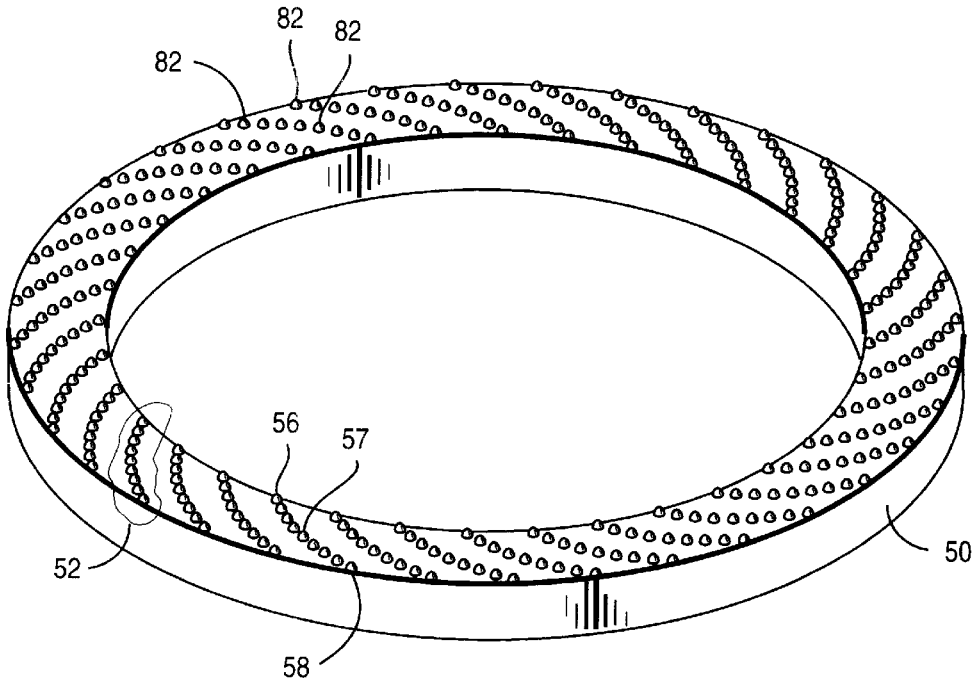
FIG. 13 is a simplified perspective view of a CMP retaining ring having arcuate raised bump surface characteristics according to one embodiment of the disclosed method and apparatus.

Although FIGS. 4 and 6 illustrate certain embodiments having arcuate and/or grooved surface characteristics 52, it will be understood with benefit of this disclosure that any outwardly inclined surface characteristic profile and/or configuration suitable for imparting outward tension to a polishing pad surface during rotation of a retaining ring against the pad surface may be employed. Examples of such other surface characteristic profiles include, but are not limited to, non-arcuate, linear or irregular characteristics having an interior ring leading edge which preceeds an exterior ring trailing edge during rotation of a retaining ring against a polishing pad surface. Examples of other possible configurations include, but are not limited to, dimpled surface characteristics made up of a plurality of dimples 80 as shown in FIG. 12 and FIG. 18, raised point surface characteristics made up of a plurality of raised points 82 as shown in FIG. 13 and FIG. 19, ridged surface characteristics made up of continuous ridges 84 as shown in FIG. 14, etc. In this regard, each of FIGS. 12–14 indicate direction of rotation such that interior ring leading edge 56 precedes exterior trailing edge 58 of each surface characteristic 52. Advantageously, non-continuous surface characteristics such as the raised bumped profiles of FIG. 13, may provide enhanced slurry transfer as well. It will be understood that the illustrated embodiments represent just a few of the many possible variations of surface characteristic profile, configuration, size and/or density that may be employed in the practice of the disclosed method and apparatus.

Figure 11:
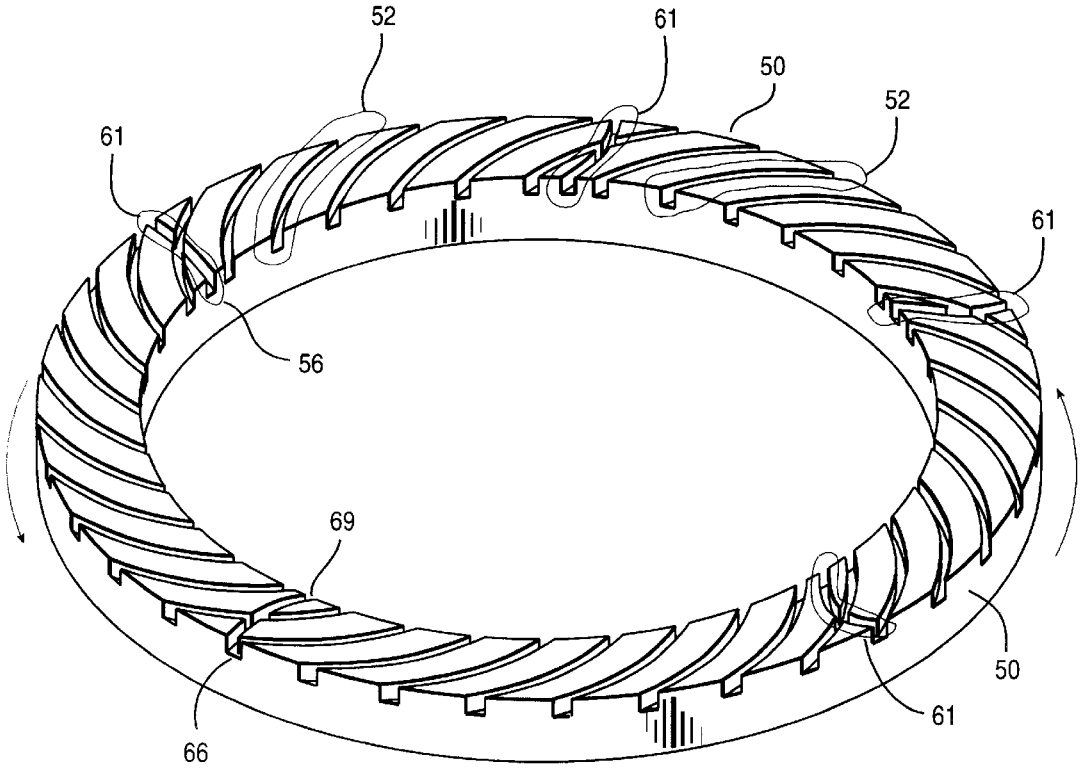
FIG. 11 is a simplified perspective view of a CMP retaining ring having arcuate grooved surface characteristics according to one embodiment of the disclosed method and apparatus.

In yet another exemplary embodiment, FIG. 11 represents a retaining ring 50 having outwardly inclined surface characteristics 52 for imparting tension onto a polishing pad in a manner as previously described. In FIG. 11, retaining ring 50 also has counter-oriented inwardly inclined surface characteristics 61 which may be provided to enhance transport of CMP slurry into the polishing area within the periphery of retaining ring 50, to further improve polishing uniformity and rate. It will be noted in FIG. 11 that leading edge 66 of each inwardly inclined surface characteristic 61 is defined on the outer periphery of retaining ring 50, rather than the inner periphery of the ring as are the leading edges of outwardly inclined surface characteristics 52. Similarly, trailing edges 69 of inwardly inclined surface characteristics 61 are defined on the inner periphery of ring 50. During polishing operations, inwardly inclined surface characteristics 61 act to direct slurry from the leading edge 66 to trailing edge 69 of each groove 61, or in a direction toward the inner periphery of ring 50, thus facilitating transfer of CMP slurry to the polishing area.

Although one particular embodiment of retaining ring 50 having counter-oriented surface characteristics is illustrated in FIG. 11, it will be understood with benefit of this disclosure that a greater or lesser ratio of inwardly inclined surface characteristics 61 may be combined with outwardly inclined surface characteristics 52, although it may be desirable that the number of outwardly inclined surface characteristics 52 outnumber the of inwardly inclined surface characteristics 61 to ensure adequate tension is applied to a pad surface during polishing in manner as previously described.

Figure 9:
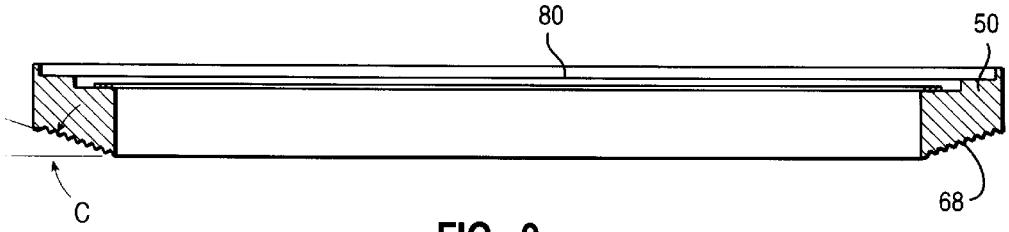
FIG. 9 is a simplified sectional view of a CMP retaining ring having an outwardly tapered lower surface according to one embodiment of the disclosed method and apparatus.
Figure 10:
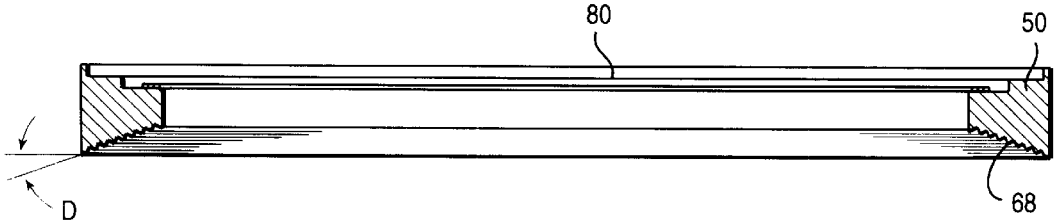
FIG. 10 is a simplified sectional view of a CMP retaining ring having an inwardly tapered lower surface according to one embodiment of the disclosed method and apparatus.

Advantageously, the disclosed outwardly inclined surface characteristics may be employed in combination with a number of other retaining ring configurations to vary or increase the amount of tension or stretch imparted to a polishing pad during a CMP process, including those described elsewhere herein. For example, FIGS. 9 and 10 illustrate examples of retaining ring surfaces 68 having serrated and tapered cross sections. In this regard, it will be understood that non-serrated tapered cross sections and non-tapered serrated cross sections are also possible, and that the angle of taper may be either inward or outward toward the outer periphery of a retaining ring. As may be noted, surface 68 of the retaining ring of FIG. 9 is tapered outwardly at an angle C of about 10° from the plane of the retaining ring. Surface 68 of the retaining ring of FIG. 10 is tapered inwardly at an angle D of about 10° from the plane of the retaining ring. Advantageously, such tapered cross sections may be employed in combination with outwardly inclined surface characteristics to increase the tension or stretch imparted to a polishing pad during a CMP process.

By employing a serrated surface in addition to an inwardly or outwardly tapered retaining ring surface, the additional feature of further outward stretching may be provided. Although particular serrated tapered retaining ring surfaces are illustrated in FIGS. 9 and 10, it will be understood that serrations of different and varying sizes, as well as flat surfaces may be alternately employed. It will also be understood that inward or outward tapers of different angles other than those pictured may also be employed. In one embodiment, for example, an outward taper may be from about 5° to about 15° from the horizontal and an inward taper may be from about 5° to about 15° from the horizontal, however, other taper angles outside these ranges are also possible. Non-tapered serrated surfaces may also be provided.

Figure 7:
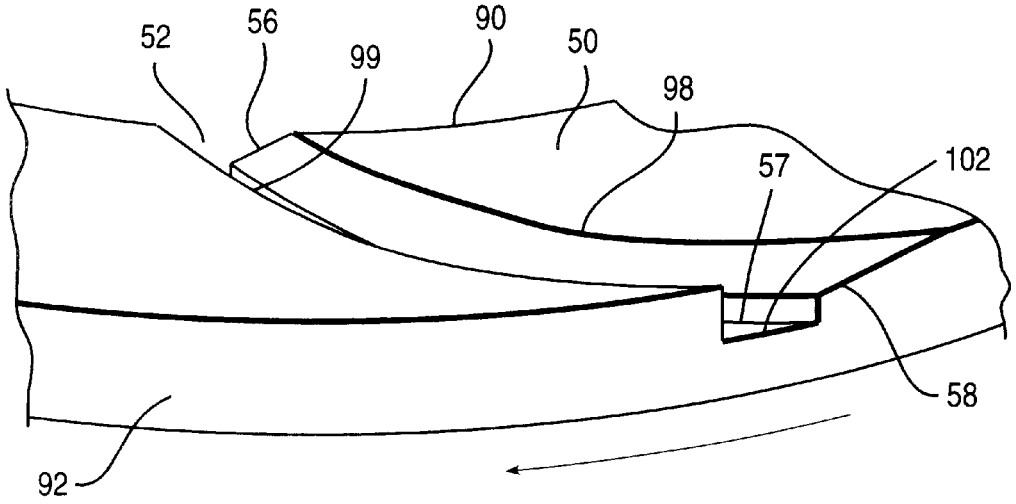
FIG. 7 is a simplified perspective view of a section of a CMP retaining ring having arcuate grooved surface characteristics according to one embodiment of the disclosed method and apparatus.

FIGS. 7 and 8 illustrate another exemplary embodiment of arcuate grooved-shaped surface characteristics 52 having an angled edge fillet or "knife edge" 98 defined on a portion of the backside of groove 57. In this regard, the "backside" of a groove or other surface characteristic profile refers to the side of an individual profile which trails the other side of the profile in reference to the direction of rotation, as illustrated by the arrows in FIGS. 7 and 8. An angled edge fillet as shown in FIGS. 7 and 8 may be employed for reasons of increased friction resulting in a larger stretching force. FIG. 8 illustrates a cross section of a groove 52 having an angled edge fillet 98 defined at an angle A of about 45° from the plane of retaining ring 50, as shown. In this regard, in one embodiment angle A may range from about 30° to about 60°, although angles greater than about 60° and less than about 30° may also be employed. Furthermore, it will be understood that angle A may be variable, for example, having a greater value at leading edge 56 of retaining ring 50, and tapering to a lesser angle at trailing edge 58. Alternatively, an angle A may be constant from leading to trailing edge, or taper in the opposite direction as well. As shown in FIG. 8, an angle edge fillet may be defined on a portion of a backside of a grooved surface characteristic. Alternatively, an angle fillet may extend across the entire backside surface from the pad-side surface 54 of retaining ring 50 to the base 102 of grooved surface characteristic 57.

In yet other embodiments, an edge fillet may be segmented to have two or more cross sectional angle values A and/or may be arcuate to present a convex and/or concave backside surface. In still other embodiments frontside surface 99 of groove 52 may additionally or alternatively be tapered or angled with an edge fillet in a similar manner. Furthermore, it will be understood with benefit of this disclosure that backside and/or frontside edge fillets may be employed with arcuate, non-arcuate and linear shaped surface characteristic profiles as described elsewhere herein.

It will be understood with benefit of this disclosure that a retaining ring 50 having the disclosed surface characteristics may be constructed with any material or combinations of material known for use in retaining rings employed in polishing operations. For example, a retaining ring 50 may be of single material construction, such as polyphenylsulfide ("PPS"), or alternatively may be a combination of materials such as a PPS ring with a stainless steel backing. Moreover, individual surface characteristics may be advantageously constructed of single or composite materials as well. For example, FIG. 8A illustrates one embodiment of the disclosed methods and apparatus employing composite grooved surface characteristics. In the embodiment illustrated in FIG. 8A, a groove backside may be provided with a surface 94 that is relatively hard (or non-wearing) compared to the remainder of retaining ring 50. For example a backside 94 may comprise a carbide layer adhered to, or otherwise affixed or disposed on a PPS CMP polishing ring 50. Advantageously, such a relatively hard wearing backside surface 94 may be employed to extend the life and wear characteristics of retaining ring 50. Other examples of relatively hard wearing surface materials include, but are not limited to, ceramics, etc. Such relatively hard wearing materials may be employed with retaining rings constructed of relatively softer materials including, but not limited to, PPS, ceramics, and mixtures thereof, etc.

Although FIG. 8A illustrates a relatively hard wearing surface 94 disposed on the backside surface 96 of a straight-walled grooved surface characteristic 52, it will be understood that such composite material construction may also be provided for use with any of the other surface characteristic shapes and configurations described elsewhere herein. For example, relatively hard wearing backside layer 94 may be provided on a grooved surface characteristic having an edge fillet 98 such as that illustrated in FIGS. 7 and 8. In other examples, relatively hard wearing composite surfaces may be provided on any other portion of a surface characteristic profile, for example, which are subject to increased wear or abrasion, including but not limited to, raised surface characteristics (e.g., ridges, bumps, etc.) or other recessed surface characteristics (e.g., dimples, etc.).

In yet other embodiments, the disclosed surface characteristics may advantageously enhance conditioning of a polishing pad, and therefore removal rate characteristics of a CMP system, by virtue of interaction between surface characteristics of a retaining ring with the upper surface of a polishing pad during the polishing process. Furthermore, composite materials may be selected to enhance pad conditioning, such as by increasing the roughness of a composite material surface which contacts a polishing pad upper surface during polishing so as to further condition the pad. In yet other embodiments, abrasive or otherwise pad conditioning characteristics may be imparted to a retaining ring lower (or pad side) surface to enhance pad conditioning without the use of composite materials. Thus, it will be understood with benefit of the present disclosure that one or more of the features of the disclosed surface characteristics may be combined in any manner deemed suitable by those of skill in the art to achieve a polished substrate edge profile and/or removal rate during polishing. Furthermore, it will be understood that any of the disclosed materials or surface characteristic configurations may be combined with others to fit individual applications.

Figure 20:
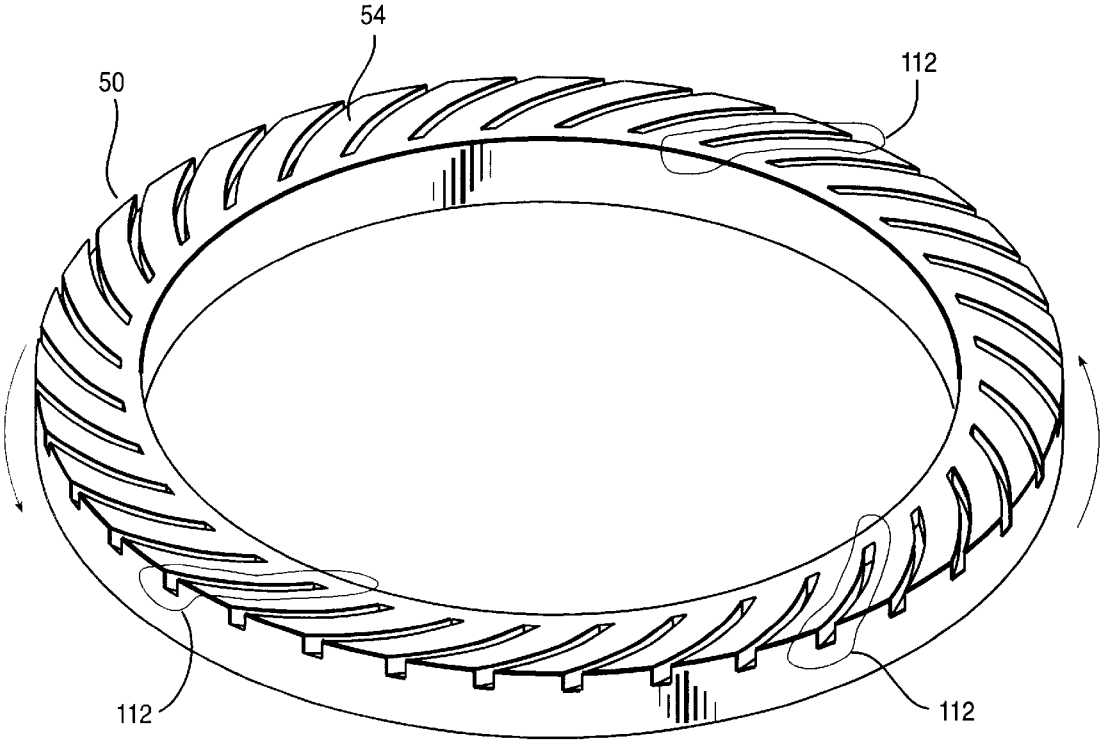
FIG. 20 is a simplified perspective view of a CMP retaining ring having partially extending arcuate grooved surface characteristics according to one embodiment of the disclosed method and apparatus.

In yet another embodiment, surface characteristic profiles that are incomplete or that only extend partially across a retaining ring lower surface from the inner periphery to the outer periphery of the ring may be provided, as exemplified by partially extending arcuate grooved surface characteristic profiles 112 in FIG. 20. As shown in FIG. 20, surface characteristic profiles 112 extend inward from the outer periphery of ring 50 but do not intersect inner periphery of ring 50, instead terminating at a point outwardly adjacent the inner periphery. It will be understood with benefit of this disclosure that the pictured embodiment is exemplary only, and that partially extending surface characteristic profiles may extend outward from an inner periphery of a retaining ring without intersecting the outer periphery, instead terminating at a point inwardly adjacent the outer periphery. Alternatively, a partially extending surface characteristic profile may be defined between an inner and outer periphery of a retaining ring 50 without intersecting either the inner or outer periphery of the ring, instead terminating at one end at a point outwardly adjacent the inner periphery and at the other end inwardly adjacent the outer periphery. Furthermore, partially extending surface characteristic profiles may comprise one or more other embodiments and features described herein including, but not limited to, raised surface characteristics, linear surface characteristic profiles, discontinuous surface characteristics, mixtures of different, etc. Partially extending surface characteristic profiles may also be combined with fully extending surface characteristic profiles on the same retaining ring surface.

Just a few examples of possible combinations include linear-shaped or arcuate-shaped surface characteristics having relatively high angle edge fillets (from about 40° to about 50°) with a relatively high surface characteristic profile count (from about 35 profiles to about 37 profiles on a retaining ring for polishing 8" wafers), relatively high angle edge fillets (as described above) combined with a relatively low profile count (from about 28 profiles to about 32 profiles on a retaining ring for polishing 8" wafers), relatively low angle edge fillets (from about 40° to about 50°) combined with a relatively high profile count (as described above), and relatively low angle edge fillets (as described above) with a relatively low profile count (as described above). Also possible are combinations of any of the above features with one or more partially extending surface characteristic profiles. These represent just a few of the many various combinations which are possible and may be employed using the disclosed method and apparatus.

It will be understood with benefit of this disclosure that CMP retaining rings provided with the disclosed surface characteristics may be advantageously used with any type of CMP polishing system, pad material and/or polishing slurry, as long as the lower (or pad-side) surface of the retaining ring contacts the polishing pad during polishing. Examples of suitable systems have been described elsewhere herein. Examples of suitable polishing pad materials include, but are not limited to, Rodel's "IC1000", Polytex "SUPREME", etc. Examples of suitable CMP slurries include, but are not limited to, Cabot "SS25", Cabot "SS12", etc.

EXAMPLES

The following examples are illustrative and should not be construed as limiting the scope of the invention or claims thereof.

Comparative Example A—Conventional Polishing

In the following comparative example two silicon wafers, an 8" BPSG patterned wafer and an 8" blank film wafer, were polished using a conventional retaining ring. In each case, polishing was carried out using an Applied Materials "MIRRA" CMP polishing system having an "IC1000" pad and conventional flat-surfaced Applied Materials "AEP" retaining ring. A CMP slurry comprising Cabot "SS25" was employed. A 84 second polishing operation was conducted with a 1.4 psi pressure differential between membrane and retaining ring pressure.

Figure 16:
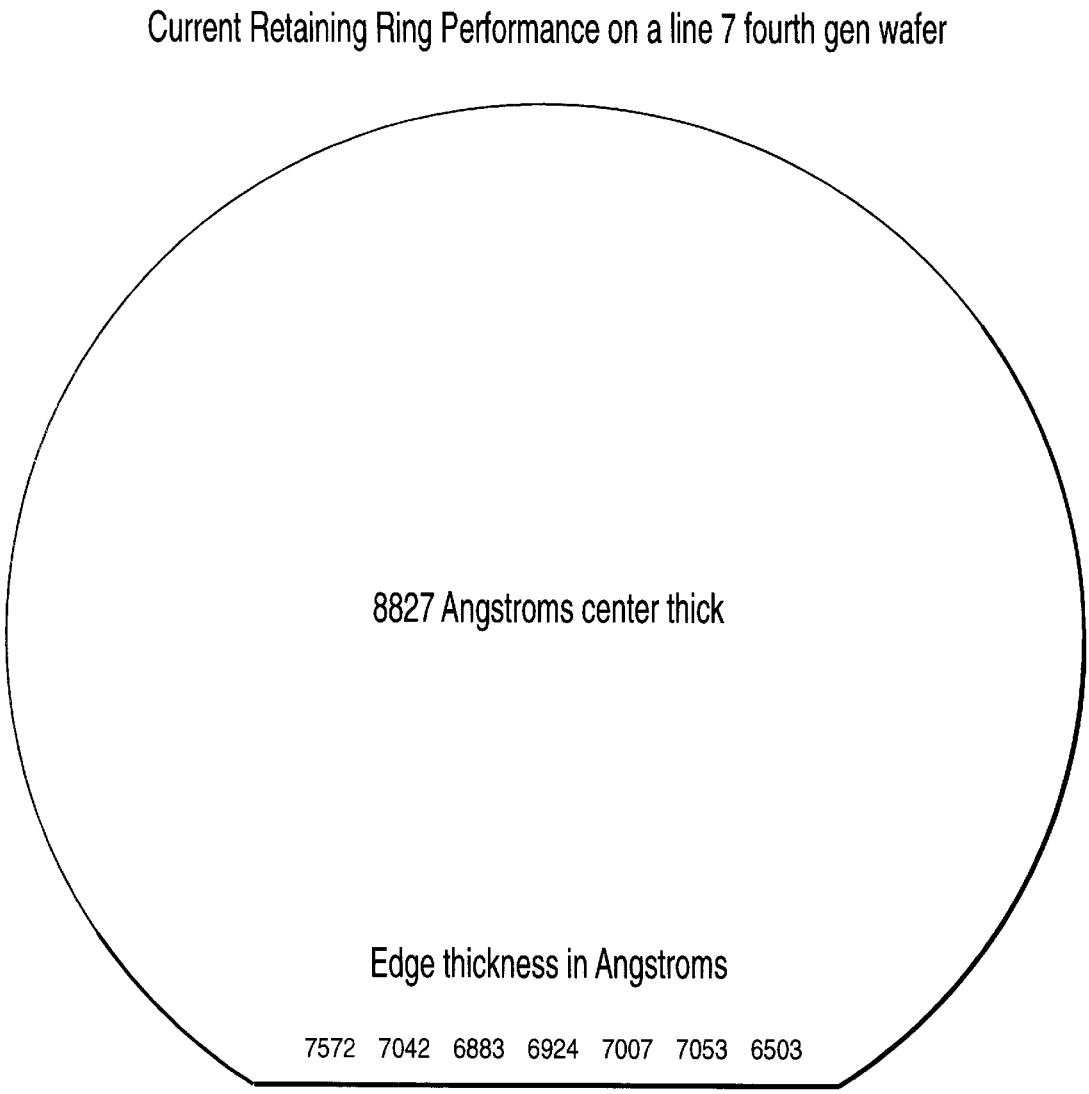
FIG. 16 is a simplified overhead view of a 64M SDRAM interlayer dielectric ("ILD") polish wafer showing center and flat thicknesses following CMP polishing with a conventional smooth-surfaced CMP retaining ring.

Following polishing, thickness of each silicon wafer was evaluated utilizing optiprobe 2600 UV. A simplified representation of the thickness of the patterned wafer is illustrated in FIG. 16, and polishing results for the blank film may is presented in Table As may be seen, polishing of the patterned wafer with a conventional retaining ring yielded a center thickness of 8827 Å, and an edge thickness that ranged from 6503 Å to 7572 Å. This translates to a thickness range of 2324 Å. During polishing, average removal rate in Å/minutes was observed to be 5300. Polishing of the blank film with a conventional retaining ring yielded a center thickness of 5746 Å, and an edge thickness that ranged 4723 Å. This translates to a thickness range of 1023 Å. During polishing, average removal rate in Å/minutes was observed to be 5326.

In the examples, both BPSG patterned and blank film wafers were evaluated to illustrate performance of CMP systems under varying conditions. In this regard, improved polishing performance on a patterned wafer is more likely to show up at the flat. Blank film wafers typically allow measurement out closer to the edge so as to illustrate how a given CMP retaining ring behaves with more sensitive films and/or CMP process.

Example 1

In this example, the procedure of Comparative Example A was repeated utilizing the same procedure, the same type of CMP system and the same type of BPSG patterned silicon wafer evaluated in Comparative Example A. However, in this case a retaining ring having one embodiment of the disclosed retaining ring surface characteristics was employed. Specifically the retaining ring was configured with surface characteristics identical to those depicted in FIG. 4 and having an edge fillet of 45°.

Figure 17:
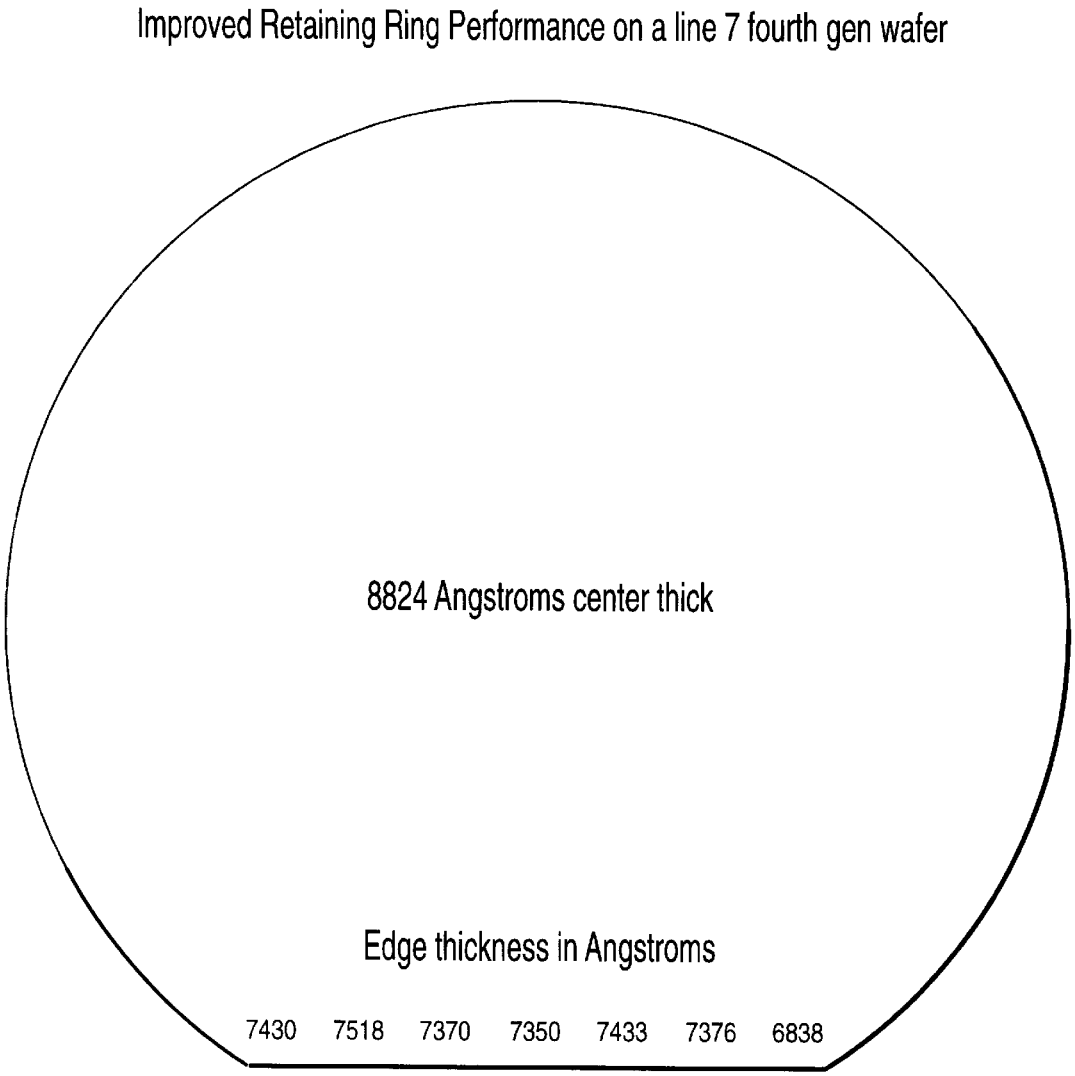
FIG. 17 is a simplified overhead view of a 64M SDRAM ILD polish wafer showing center and flat thicknesses following CMP polishing with a retaining ring having surface characteristics according to one embodiment of the disclosed method and apparatus.

FIG. 17 is a simplified illustration of the wafer thickness achieved with the retaining ring having the above-described surface characteristics. After polishing, the center wafer thickness was measured to be 8824 Å, while the edge wafer thickness ranged from 6838 Å to 7430 Å. This translates to a thickness range of 1986 Å. During polishing, average removal rate was 5800 Å/minute.

Results of this example illustrate that a retaining ring having the disclosed surface characteristics provided enhanced removal rate and enhanced thickness uniformity, as compared to a conventional retaining ring. In particular, edge profile thickness was enhanced.

Example 2

In this example, the procedure of Comparative Example A was repeated utilizing the same procedure, the same type of CMP system and the same type of blank film wafer evaluated in Comparative Example A. However, in this case a retaining ring having one embodiment of the disclosed retaining ring surface characteristics was employed. Specifically the same retaining ring as used in Example 1 was employed in the polishing operation of Example 2.

Figure 15:
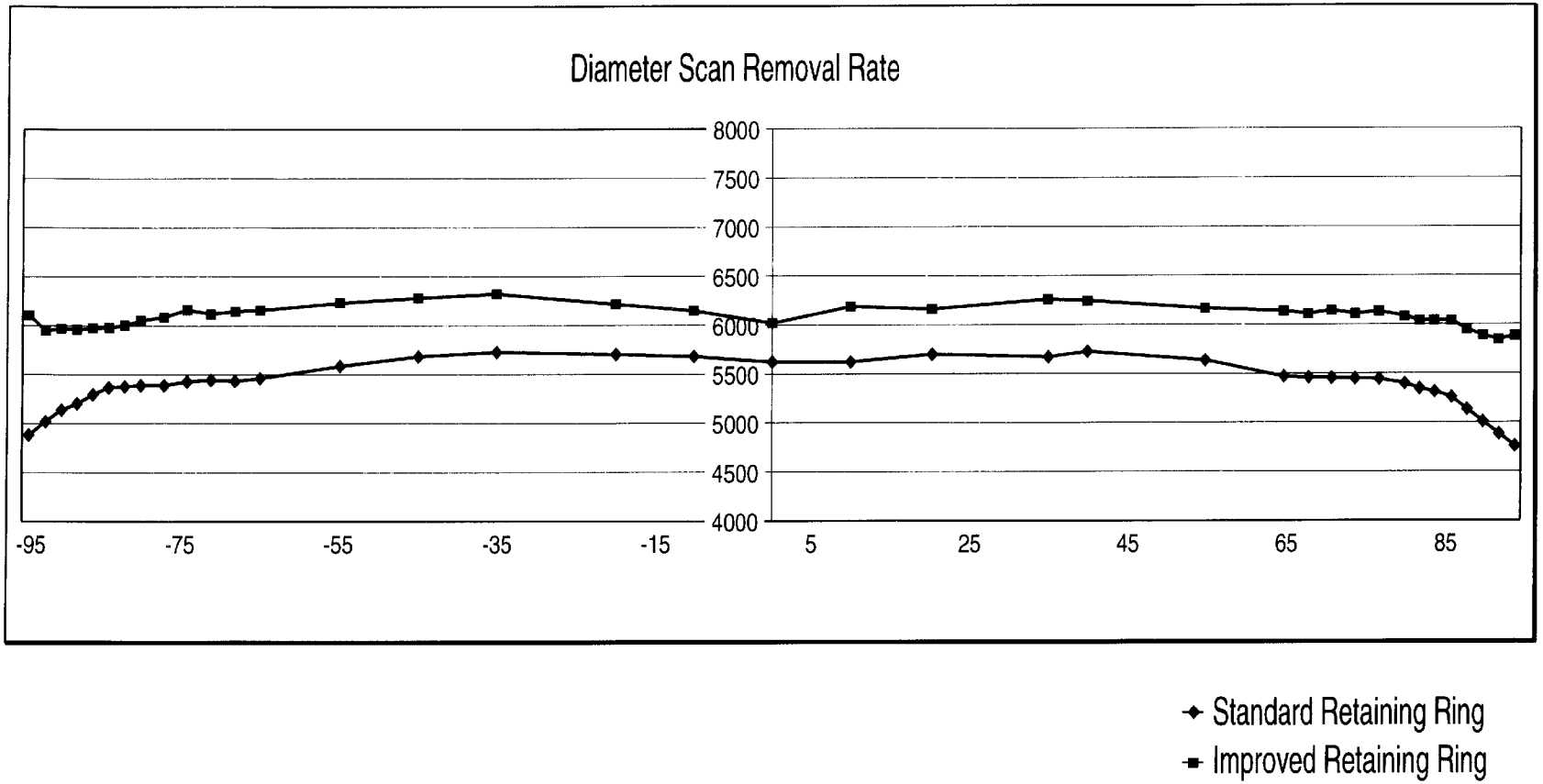
FIG. 15 shows diameter scan removal rate for CMP polishing of 8" flatted BPSG wafer using a conventional flat surface CMP retaining ring and a CMP retaining ring having surface characteristics according to one embodiment of the disclosed method and apparatus.

FIG. 15 illustrates the results of polishing operations conducted on the 8" blank film wafer. Blank film polishing results for both conventional retaining ring, and for retaining ring having the disclosed surface characteristics are shown in Table 1.

TABLE 1

Polishing Results on Blank Film Wafers
(41 point diameter scan with an edge exclusion of 5 mm)

| | Avg. Removal Rate (Å/minute) | Std. Dev. | Min. Thicknes s (Å) | Max. Thicknes s (Å) | Thicknes s Range (Å) | % Std. Dev. |
|---|---|---|---|---|---|---|
| Conventional retaining ring | 5326 | 264 | 4723 | 5746 | 1023 | 4.96 |
| Retaining ring with disclosed surface characteristics | 6013 | 124 | 5840 | 6349 | 509 | 2.06 |

The results of this example show the improved edge performance on blank film wafers that is protecting the flat on patterned wafers. From FIG. 15 and Table 1 it may be seen that increased removal rate was achieved with the retaining ring having the disclosed surface characteristics. In addition, improved wafer thickness uniformity was obtained with the disclosed surface characteristics. In this regard, average thickness range of 509 Å, compared to 1023 Å for the conventional retaining ring was achieved. This translates to a percent standard deviation of 2.06 for the retaining ring having the disclosed surface characteristics as compared to a percent standard deviation of 4.96% for the conventional flat surfaced retaining ring. Thus, the disclosed characteristics provided both improved polished wafer thickness uniformity, and enhanced or increased removal rate during polishing.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed methods and apparatus may be utilized in various combinations and/or independently. Thus the invention is not limited to only those combinations shown herein, but rather may include other combinations.

What is claimed is:

1. A CMP retaining ring, comprising:

an inner peripheral surface;

an outcr peripheral surface;

a lower surface adapted to contact and depress an upper surface of a polishing pad during chemical mechanical polishing of a lower surface of a substrate contained within said inner peripheral surface of said retaining ring during chemical mechanical polishing; and first surface characteristics defined on said lower surface of said retaining ring and extending from a position at or adjacent said inner peripheral surface of said retaining ring, to a position at or adjacent said outer peripheral surface of said retaining ring, said first surface characteristics having a plurality of protrusions, recesses, or a nixture thereof and being outwardly inclined relative to a direction of relative rotation between said lower surface of said retaining ring and said upper surface of said pad to impart dynamic peripheral stretching action to said upper surface of said pad in a direction away from a portion of said pad adjacent said substrate toward a portion of said pad in contact with said lower surface of said retaining ring.

2. The CMP retaining ring of claim 1, wherein said lower surface of said retaining ring is inwardly or outwardly tapered.

3. The CMP retaining ring of claim 1, wherein said first surface characteristics comprise partially extending surface characteristics.

4. The CMP retaining ring of claim 1, wherein said first surface features comprise a plurality of recesses.

5. The CMP retaining ring of claim 1, wherein said first surface features comprise a plurality of protrusions.

6. The CMP retaining ring of claim 1, wherein said first surface characteristics comprise a plurality of recesses, each of said rcccsses comprising a groove defined in said lower surface of said retaining ring and extending from a leading edge defined at said inner peripheral surface of said retaining ring to a trailing edge at said outer peripheral surface of said retaining ring, the goove having a front side surface.

7. The CMP retaining ring of claim 6, wherein said groove defines an arcuate shape between said leading and trailing edges.

8. The CMP retaining ring of claim 7, wherein said arcuate shape is defined to have a radius of from about 55% to about 65% of an interior peripheral radius of said retaining ring as measured from a center point located on a circle having a radius of from about 70% to about 75% of said interior peripheral radius of said retaining ring as measured from a center point of said retaining ring.

9. The CMP retaining ring of claim 6, wherein said groove has an angled edge fillet defined on a backside surface of said groove.

10. The CMP retaining ring of claim 9, wherein said angled edge fillet is adapted to impart increased dynamic peripheral stretching action to said upper surface of said pad by increasing dynamic frictional forces between said surface features and said upper surface of said pad during chemical mechanical polishing.

11. The CMP retaining ring of claim 1, further comprising second surface characteristics defined on said lower surface of said retaining ring and extending from a position at or adjacent said outer peripheral surface of said retaining ring to a position at or adjacent said inner peripheral surface of said retaining ring, said second surface characteristics comprising a plurality of protrusions or recesses inwardly inclined relative to a direction of relative rotation between said lower surface of said retaining ring and said upper surface of said pad.

12. The CMP retaining ring of claim 11, wherein said first and second surface characteristics comprise, resrectivly, a first plurality of grooves and a second plurality of grooves, said first pluralitX of grooves extending from a leading edge defined at said inner peripheral surface of said retaining ring to a trailing edge at said outer peripheral surface of said retaining ring, and said second plurality of grooves extending from a leading edge defined at an outer peripheral surface of said retaining ring to a trailing edge defined at an inner peripheral surface of said retaining ring.

13. The CMP retaining ring of claimn 1, wherein said retaining ring comprises at least one first material and said first surface features comprise at least one second material to form first surface features of composite construction.

14. The CMP retaining ring of claim 13, wherein said first surface characteristics of composite construction comprise a plurality of recesses, each of said recesses comprising a groove defined in said lower surface of said retaining ring and having a front side, said retaining ring comprises polyphenylsulfide and a backside of said groove comprises carbide.

15. A CMP head assembly, comprising:

a carrier plate adapted to apply downward pressure to a substrate so that a lower surface of said substrate is pressed against an upper surface of a polishing pad during chemical mechanical polishing;

a retaining ring adapted to contain said substrate within an inner peripheral surface of said retaining ring during said chemical mechanical polishing, said retaining being adjustably mounted to said carrier plate and having a lower surface adapted to apply a downward pressure to said upper surface of said polishing pad independent of the downward pressure applied to said upper surface of said polishing pad by said canrier plate; and first surface characteristics defined on a lower surface of said retaining ring and extending from a position at or adjacent said inner peripheral surface of said retaining ring to a position at or adjacent said outer peripheral surface of said retaining ring, said first surface characteristics having a plurality of protrusions, recesses, or a mixture thereof and being outwardly inclined relative to a direction of relative rotation betweeen said lower surface of said retaining ring and said upper surface of said pad to impart a dynamic peripheral stretching action to said upper surface of said pad during said chemical mechanical polishing, such that the pressure uniformity between said upper surface of said pad and said lower surface of said substrate is increased.

16. The CMP head assembly of claim 15, wherein said first surface characteristics comprise a plurality of recesses, each of said recesses comprising an outwardly inclined groove defined in said lower surface of said retaining ring and extending from a leading edge defined at said inner peripheral surface of said retaining ring to a trailing edge at said outer peripheral surface of said retaining ring, the groove having a front side surface.

17. The CMP head assembly of claim 16, wherein said groove defines an arcuate shape between said leading and trailing edges.

18. The CMP head assembly of claim 16, wherein said groove has an angled edge fillet defined on a backside surface of said groove.

19. The CMP head assembly of claim 16, wherein said groove defines an arcuate shape between said leading and trailing edges, and said groove has an angled edge fillet defined on a backside surface of said groove.

20. The CMP head assembly of claim 16, further comprising second surface characteristics defined on said lower surface of said retaining ring and extending from a position at or adjacent said outer peripheral surface of said retaining ring to a position at or adjacent said inner peripheral surface of said retaining ring, said second surface characteristics comprising a plurality of groove inwardly inclined relative to the direction of relative rotation betwccn said lower surface of said retaining ring and said upper surface of said pad each of said inwardly inclined grooves intersecting one of said outwardly inclined grooves.

21. The CMP head assembly of claim 16, wherein said retaining ring comprises at least one first material and said first surface characteristics comprise at least one second material to form first surface characteristics of composite construction.

22. The CMP head assembly of claim 21, wherein said retaining ring comprises polyphenylsulfide and a backside of said grooved profile comprises carbide.

* * * * *

UNITED STATES PATENT AND TRADEMARK OFFICE

CERTIFICATE OF CORRECTION

PATENT NO. : 6,224,472 B1
DATED : May 1, 2001
INVENTOR(S) : Lei Ping Lai et al.

It is certified that error appears in the above-identified patent and that said Letters Patent is hereby corrected as shown below:

Column 18,
Line 12-13, delete "may is presented in Table" and substitute -- is presented in Table 1. -- therefor;

Claim 1,
Line 53, delete "outcr" and substitute -- outer -- therefor;
Line 62, delete "," after the word "ring";
Line 65, delete "nixture" and substitute -- mixture -- therefor;

Claim 6,
Line 34, delete "rcccsses" and substitute -- recesses -- therefor;

Claim 12,
Line 2, delete "resrectively" and substitute -- respectively -- therefor;
Line 4, delete "pluralitX" and substitute -- plurality -- therefor;

Claim 13,
Line 11, delete "claimn" and substitute -- claim -- therefor;

Claim 20,
Line 31, delete "groove" and substitute -- grooves -- therefor;
Line 32, delete "betwccn" and substitute -- between -- therefor; and
Line 34, insert -- , -- between "pad" and "each".

Signed and Sealed this

Fifth Day of February, 2002

*Attest:*

*Attesting Officer*

JAMES E. ROGAN
*Director of the United States Patent and Trademark Office*